US012654912B2

(12) United States Patent
Minnette et al.

(10) Patent No.: US 12,654,912 B2
(45) Date of Patent: Jun. 16, 2026

(54) FOILLESS CAPS

(71) Applicant: Nypro Inc., Clinton, MA (US)

(72) Inventors: Jeffrey C. Minnette, St. Petersburg, FL (US); Ryan P. Davidson, St. Petersburg, FL (US); Randall K. Julian, St. Petersburg, FL (US)

(73) Assignee: Nypro Inc., Clinton, MA (US)

( * ) Notice: Subject to any disclaimer, the term of this patent is extended or adjusted under 35 U.S.C. 154(b) by 765 days.

(21) Appl. No.: 17/616,282

(22) PCT Filed: Jun. 3, 2020

(86) PCT No.: PCT/US2020/035854

§ 371 (c)(1),
(2) Date: Dec. 3, 2021

(87) PCT Pub. No.: WO2020/247449

PCT Pub. Date: Dec. 10, 2020

(65) Prior Publication Data

US 2022/0250805 A1 Aug. 11, 2022

Related U.S. Application Data

(60) Provisional application No. 62/856,400, filed on Jun. 3, 2019.

(51) Int. Cl.
*B65D 41/34* (2006.01)
*B65D 41/04* (2006.01)
(Continued)

(52) U.S. Cl.
CPC ..... *B65D 41/3447* (2013.01); *B65D 41/0471* (2013.01); *B65D 41/325* (2013.01);
(Continued)

(58) Field of Classification Search
CPC ..... B65D 41/3447; B65D 41/325; B65D 2203/12; B65D 2251/01; B65D 41/0471;
(Continued)

(56) References Cited

U.S. PATENT DOCUMENTS 4,138,028 A * 2/1979 Price ..... B65D 50/046 215/216
4,471,878 A 9/1984 Davis et al.
(Continued)

FOREIGN PATENT DOCUMENTS

CN 1175930 A 3/1998
CN 108883860 A 11/2018
(Continued)

*Primary Examiner* — Don M Anderson
*Assistant Examiner* — Jennifer Castriotta
(74) *Attorney, Agent, or Firm* — Young Basile Hanlon & MacFarlane, P.C.

(57) ABSTRACT

Foilless caps that provide sealing of the container without the use of a foil and are environmentally friendly. The foilless caps may include tamper evident mechanisms to provide evidence of prior or attempted use. The foilless caps may further include tether mechanisms to prevent loss of the cap after opening. The foilless caps may provide sealing and resealing of the container with enough closure to maintain freshness. The foilless caps may provide a non back-off feature which may include audible and tactile indications to the user that the container is closed. The foilless caps may provide mechanisms to hold an opened and tethered cap away from the container opening during use.

15 Claims, 29 Drawing Sheets

(51) Int. Cl.
*B65D 41/32* (2006.01)
*B65D 55/16* (2006.01)

(52) U.S. Cl.
CPC ..... *B65D 55/16* (2013.01); *B65D 2203/12* (2013.01); *B65D 2251/023* (2013.01)

(58) Field of Classification Search
CPC ..... B65D 41/3438; B65D 41/3428; B65D 41/3423
See application file for complete search history.

(56) References Cited

U.S. PATENT DOCUMENTS 4,493,427 A * 1/1985 Wolkonsky ..... B65D 23/06 215/901
4,511,053 A * 4/1985 Brandes ..... B65D 41/3438 215/252
4,567,991 A * 2/1986 Anderson ..... B65D 41/3409 215/256
4,635,808 A * 1/1987 Nolan ..... B65D 41/3452 215/321
4,679,696 A * 7/1987 Bonnenfant ..... B65D 51/145 215/276
5,105,960 A * 4/1992 Crisci ..... B65D 41/3409 215/217
5,465,858 A * 11/1995 Gargione ..... B65D 41/3438 215/253
5,582,308 A * 12/1996 Kishi ..... B65D 41/3438 215/252
5,725,115 A 3/1998 Bosl et al.
5,813,553 A * 9/1998 Herr ..... B65D 41/3438 215/252
2012/0298666 A1 11/2012 Kwon
2019/0071225 A1 3/2019 Bertram et al.

FOREIGN PATENT DOCUMENTS

EP 0345173 A1 12/1989
EP 0507706 B1 3/1995
TW 201144172 A 12/2011
WO 9101924 A1 2/1991
WO 2017133948 A1 8/2017

* cited by examiner

FOILLESS CAPS

CROSS-REFERENCE TO RELATED APPLICATION(S)

This application is a national stage entry of International Patent Application Serial No. PCT/US2020/035854, filed Jun. 3, 2020, which claims priority to U.S. Provisional Application Ser. No. 62/856,400, filed Jun. 3, 2019, the entire disclosures of which are incorporated herein.

TECHNICAL FIELD

This disclosure relates to packaging and in particular, foilless caps for containers.

BACKGROUND

Containers, such as bottles, use foils to seal and contain a material in the container. Removal of the seal allows access to the material. However, placement of the foil adds complications to manufacturing. Moreover, once the seals are removed, caps may not provide sufficient closure of the container. In addition, the removed seals are not environmentally friendly as they are an additional disposable.

Containers, such as bottles, also use caps to seal and contain a material in the container. Removal of the cap allows access to the material. However, the cap may be mislaid or lost, and re-closing of the container is then not possible.

SUMMARY

Disclosed herein are foilless caps, foilless and tamper evident caps, and foilless, tamper evident and tethered caps. In an implementation, the foilless caps provide sealing of the container without the use of a foil and are environmentally friendly. In an implementation, the foilless and tamper evident caps provide sealing of the container without the use of a foil and provide evidence of prior or attempted use. In an implementation, the foilless, tamper evident, and tethered caps provide sealing of the container without the foil, anti-tampering mechanisms, and prevent loss of the cap after opening. In an implementation, the foilless caps, the foilless and tamper evident caps, and the foilless, tamper evident and tethered caps may provide sealing and resealing of the container with enough closure to maintain freshness. In an implementation, the foilless caps, the foilless and tamper evident caps, and the foilless, tamper evident and tethered caps may provide a non-backoff feature which may include audible and tactile indications to the user that the container is closed. In an implementation, the foilless and tethered caps may provide mechanisms to hold an opened and tethered cap away from the container opening during use.

BRIEF DESCRIPTION OF THE DRAWINGS

The disclosure is best understood from the following detailed description when read in conjunction with the accompanying drawings and are incorporated into and thus constitute a part of this specification. It is emphasized that, according to common practice, the various features of the drawings are not to-scale. On the contrary, the dimensions of the various features are arbitrarily expanded or reduced for clarity.

DETAILED DESCRIPTION

Figure 1:
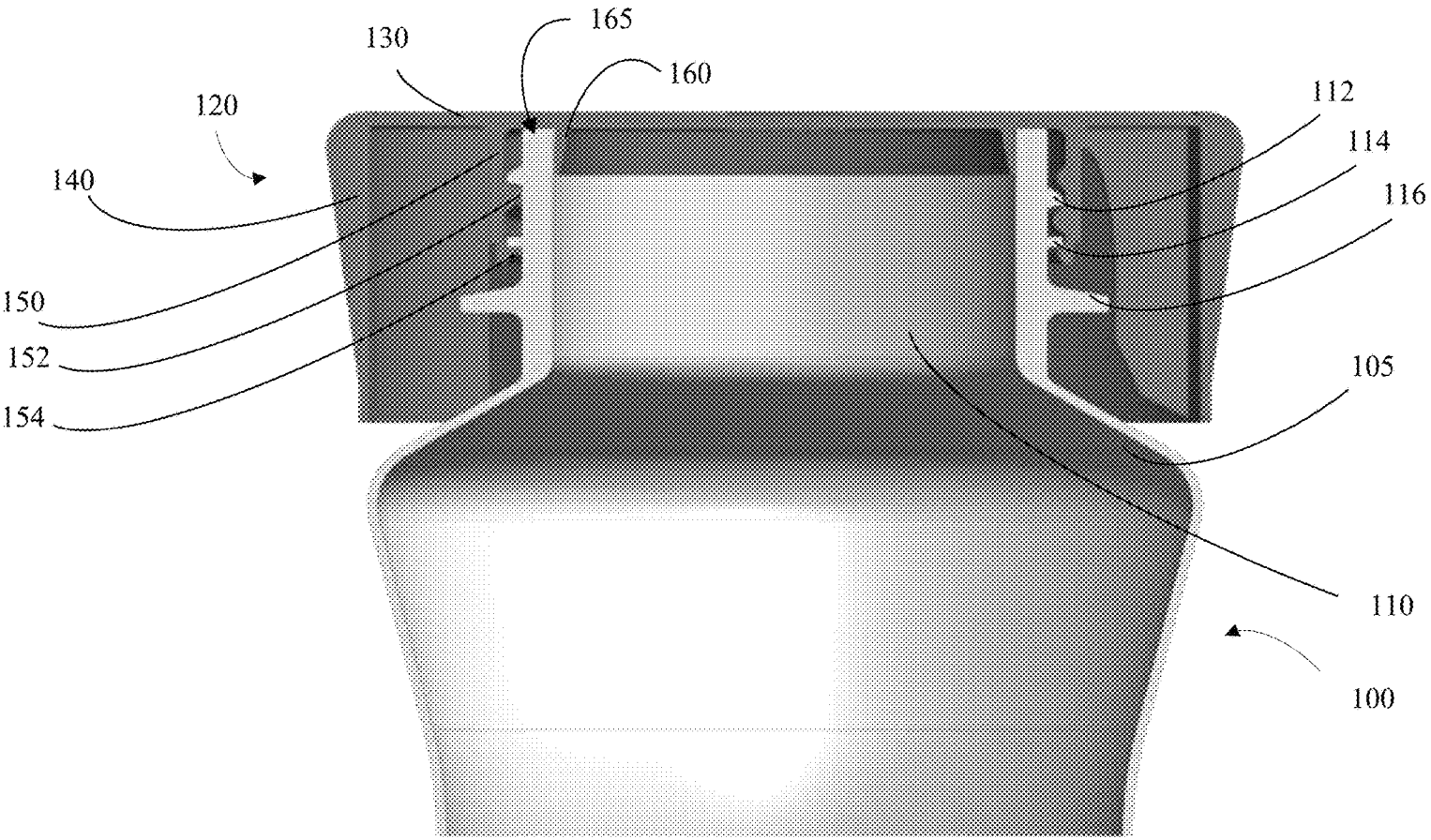
FIG. 1 is a foilless cap in accordance with implementations.

The figures and descriptions provided herein may be simplified to illustrate aspects of the described embodiments that are relevant for a clear understanding of the herein disclosed processes, machines, manufactures, and/or compositions of matter, while eliminating for the purpose of clarity other aspects that may be found in typical similar devices, systems, compositions and methods. Those of ordinary skill may thus recognize that other elements and/or steps may be desirable or necessary to implement the devices, systems, compositions and methods described herein. However, because such elements and steps are well known in the art, and because they do not facilitate a better understanding of the disclosed embodiments, a discussion of such elements and steps may not be provided herein. However, the present disclosure is deemed to inherently include all such elements, variations, and modifications to the described aspects that would be known to those of ordinary skill in the pertinent art in light of the discussion herein.

Embodiments and implementations are provided throughout so that this disclosure is sufficiently thorough and fully conveys the scope of the disclosed embodiments to those who are skilled in the art. Numerous specific details are set forth, such as examples of specific aspects, devices, and methods, to provide a thorough understanding of embodiments of the present disclosure. Nevertheless, it will be apparent to those skilled in the art that certain specific disclosed details need not be employed, and that embodiments may be embodied in different forms. As such, the exemplary embodiments set forth should not be construed to limit the scope of the disclosure.

The terminology used herein is for the purpose of describing particular embodiments only and is not intended to be limiting. For example, as used herein, the singular forms "a", "an" and "the" may be intended to include the plural forms as well, unless the context clearly indicates otherwise. The terms "comprises," "comprising," "including," and "having," are inclusive and therefore specify the presence of stated features, steps, operations, elements, and/or components, but do not preclude the presence or addition of one or more other features, steps, operations, elements, components, and/or groups thereof.

The steps, processes, and operations described herein are thus not to be construed as necessarily requiring their respective performance in the particular order discussed or illustrated, unless specifically identified as a preferred or required order of performance. It is also to be understood that additional or alternative steps may be employed, in place of or in conjunction with the disclosed aspects.

Yet further, although the terms first, second, third, etc. may be used herein to describe various elements, steps or aspects, these elements, steps or aspects should not be limited by these terms. These terms may be only used to distinguish one element or aspect from another. Thus, terms such as "first," "second," and other numerical terms when used herein do not imply a sequence or order unless clearly indicated by the context. Thus, a first element, step, component, region, layer or section discussed below could be termed a second element, step, component, region, layer or section without departing from the teachings of the disclosure.

The non-limiting embodiments described herein are with respect to foilless caps, foilless and tamper evident caps, and foilless, tamper evident and tethered caps. The foilless caps, the foilless and tamper evident caps, and the foilless, tamper evident and tethered caps and methods for making the foilless caps, the foilless and tamper evident caps, and the foilless, tamper evident and tethered caps may be modified for a variety of applications and uses while remaining within the spirit and scope of the claims. The embodiments and variations described herein, and/or shown in the drawings, are presented by way of example only and are not limiting as to the scope and spirit. The descriptions herein may be applicable to all embodiments of the device and the methods for making the devices.

Disclosed herein are implementations of foilless caps, foilless and tamper evident caps, and foilless, tamper evident and tethered caps. The implementations shown are illustrative and other implementations may include grips or protrusions for aiding in opening the cap which are within the scope of the specification and claims described herein.

Figure 2:
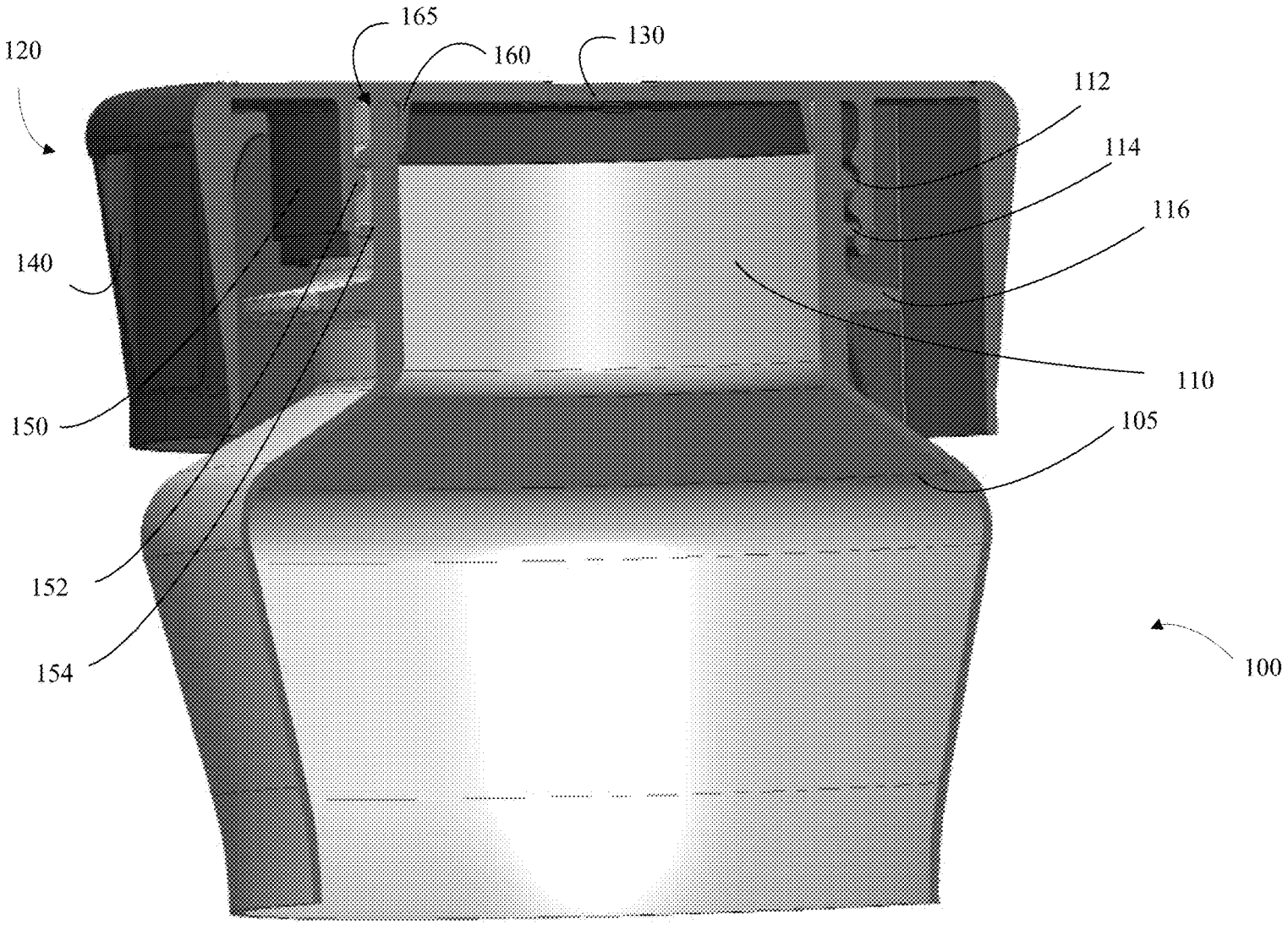
FIG. 2 is a cross-sectional view of the foilless cap of FIG. 1 in accordance with certain implementations.

FIG. 1 is a diagram of a container 100 with a foilless cap 120 positioned in a closed position in accordance with implementations and FIG. 2 is a cross-sectional view of the container 100 and the foilless cap 120 of FIG. 1 in accordance with certain implementations. The container 100 includes a shoulder 105 and a neck 110. The neck 110 includes threads 112 and 114 and a collar 116, all of which face outward from the neck 110.

The foilless cap 120 includes a base 130, an outer sidewall 140, a middle sidewall 150 and an inner sidewall 160. The width of the base 130 is dimensioned to accommodate the width of the shoulder 105 of the container 100 and the height of the outer sidewall 140 is dimensioned to accommodate the height of at least the neck 110 of the container 100. The middle sidewall 150 has projections 152 and 154 which face toward the inner sidewall 160. The projections 152 and 154 of the middle sidewall 150 are shaped to diametrically interfere with and frictionally fit with the threads 112 and 114 of the container 100 to provide a non back-off mechanism which provides an audible and tactile indicator to a consumer or user that the container 100 is closed. The inner sidewall 160 is angled downward toward the middle sidewall 150 and configured to fit inside the neck 110 of the container 100. The middle sidewall 150 and the inner sidewall 160 thus form a V-shaped groove 165 which is designed to engage the neck 110 of the container 100 and provide a linerless plug seal for the container 100. The foilless cap 120 thus eliminates (i.e., is absent of) the foil seal and lining operations.

Figure 3:
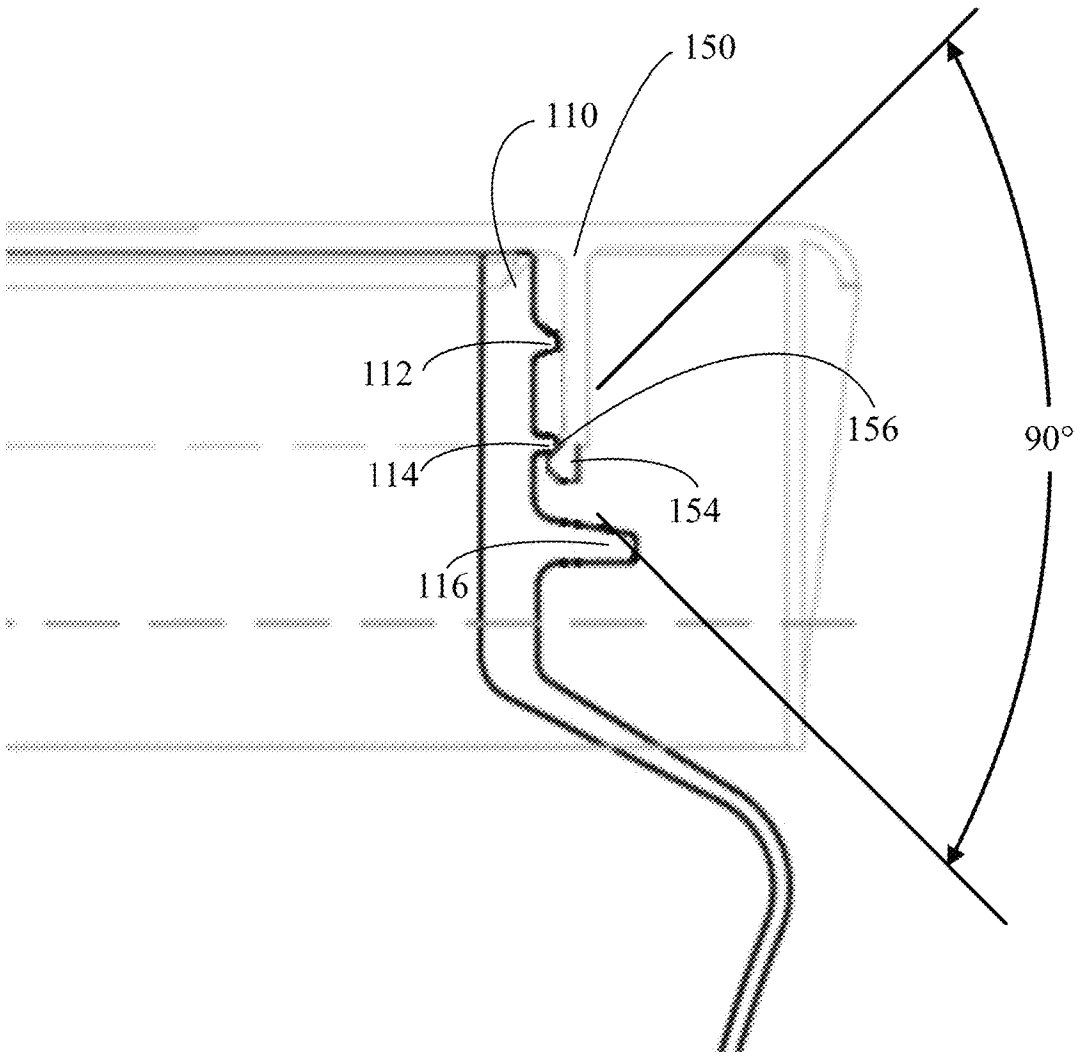
FIG. 3 is a diagram illustrating the non back-off mechanism of FIG. 1 in accordance with certain implementations.

FIG. 3 is a diagram illustrating the non back-off mechanism of FIG. 1 and FIG. 2 in accordance with certain implementations. Certain elements which are illustrated in FIG. 1 and FIG. 2 are not labeled in FIG. 3 for purposes of clarity. In particular, the projection 154 of the middle wall 150 is shown in an engaged position with the thread 114 of the neck 110. In an implementation, an engaging surface 156 of the projection 154 may be at a 90° angle as shown in FIG. 3.

Figure 4:
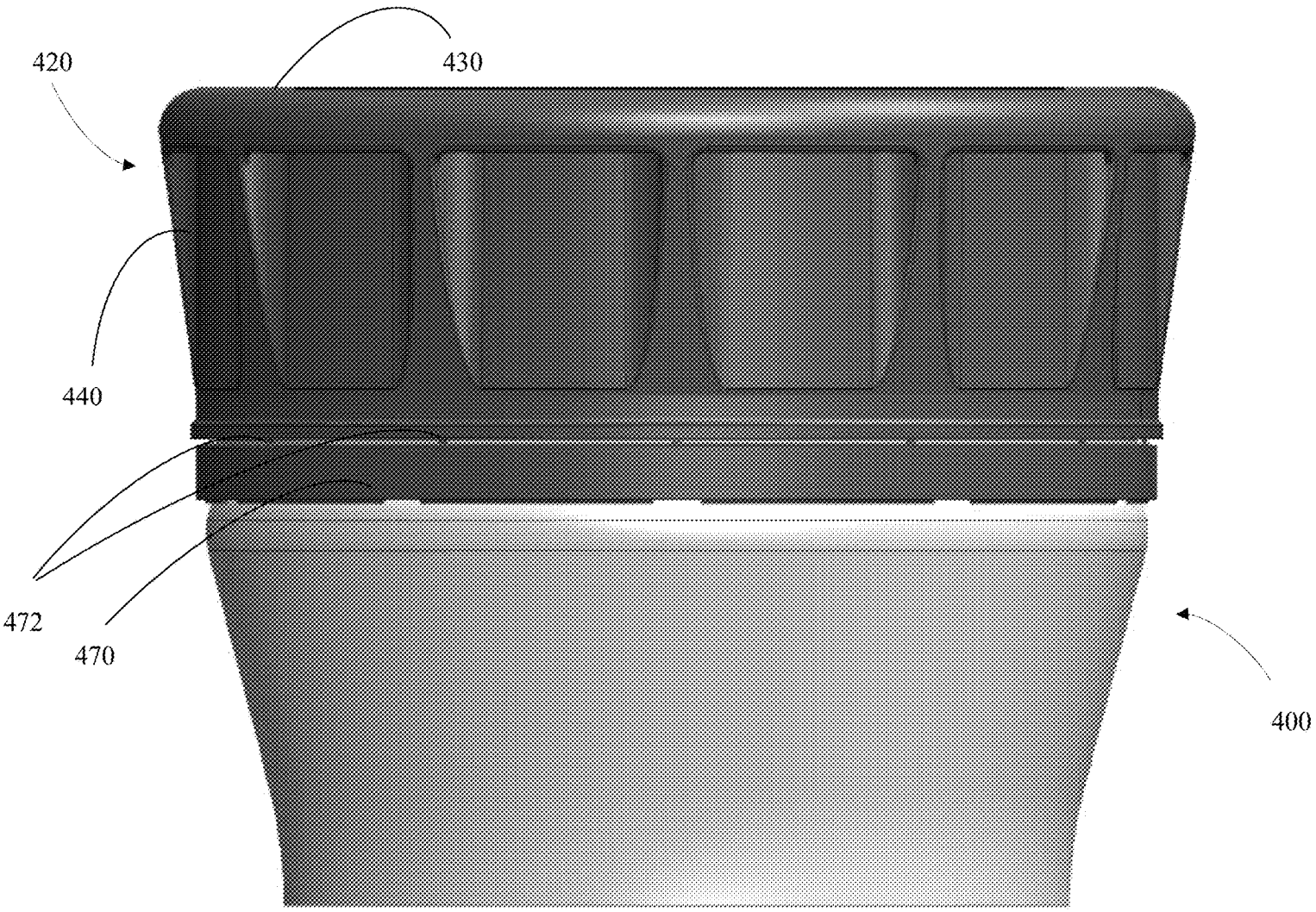
FIG. 4 is a foilless cap with tamper evident band in accordance with certain implementations.

FIG. 4 is a diagram of a container 400 with a foilless and tamper evident cap 420 positioned in a closed position in accordance with certain implementations. The foilless and tamper evident cap 420 includes a base 430 and an outer sidewall 440. The foilless and tamper evident cap 420 further includes a tamper evident band 470 with is attached to the outer sidewall 440 via tearable retaining elements 472.

Figure 5:
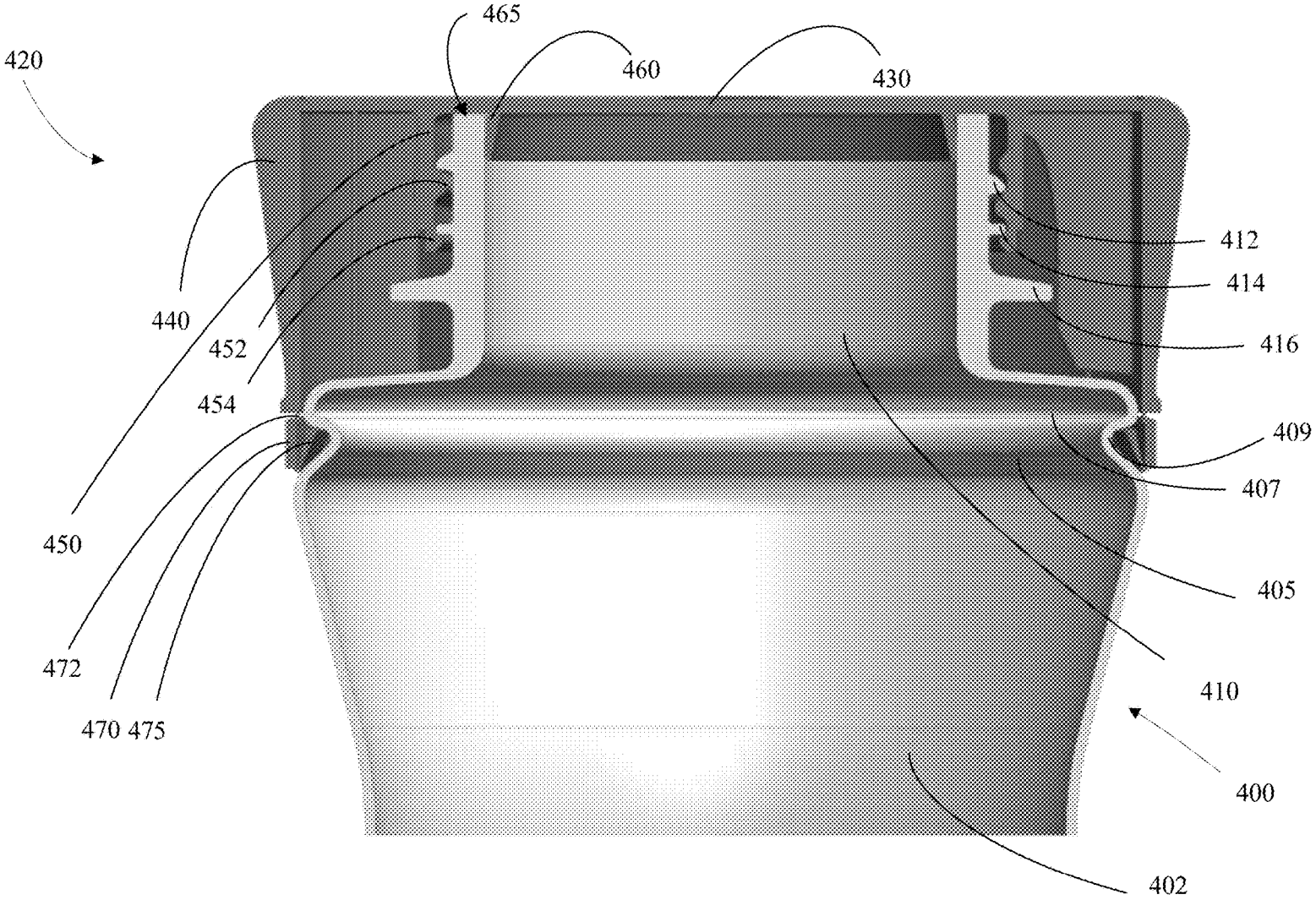
FIG. 5 is a cross-sectional view of foilless cap with tamper evident band of FIG. 4 in accordance with certain implementations.

FIG. 5 is a cross-sectional view of the container 400 and the foilless and tamper evident cap 420 of FIG. 4 in accordance with certain implementations. The container 400 includes a body 402, a shoulder 405, and a neck 410. The neck 410 includes threads 412 and 414 and a collar 416, all of which face outward from the neck 410. The shoulder 405 includes a retaining ring 407.

The foilless and tamper evident cap 420 includes the base 430, the outer sidewall 440, a middle sidewall 450, and an inner sidewall 460. The width and height of the outer sidewall 440 and the base 430 are dimensioned to accommodate the width of the shoulder 405 and the retaining ring 407 of the container 400 and the height of at least the neck 410 and the shoulder 405 of the container 400. The middle sidewall 450 has projections 452 and 454 which face toward the inner sidewall 460. The projections 452 and 454 of the middle sidewall 450 are shaped to diametrically interfere with and frictionally fit with the threads 412 and 414 of the container 400 to provide a non back-off mechanism which provides an audible and tactile indicator to a consumer or user that the container 400 is closed. The inner sidewall 460 is angled downward toward the middle sidewall 450 and configured to fit inside the neck 410 of the container 400. The middle sidewall 450 and the inner sidewall 460 thus form a V-shaped groove 465 which is designed to engage the neck 410 of the container 400 and provide a linerless plug seal for the container 400. The foilless and tamper evident cap 420 thus eliminates the foil seal and lining operations.

Figure 6:
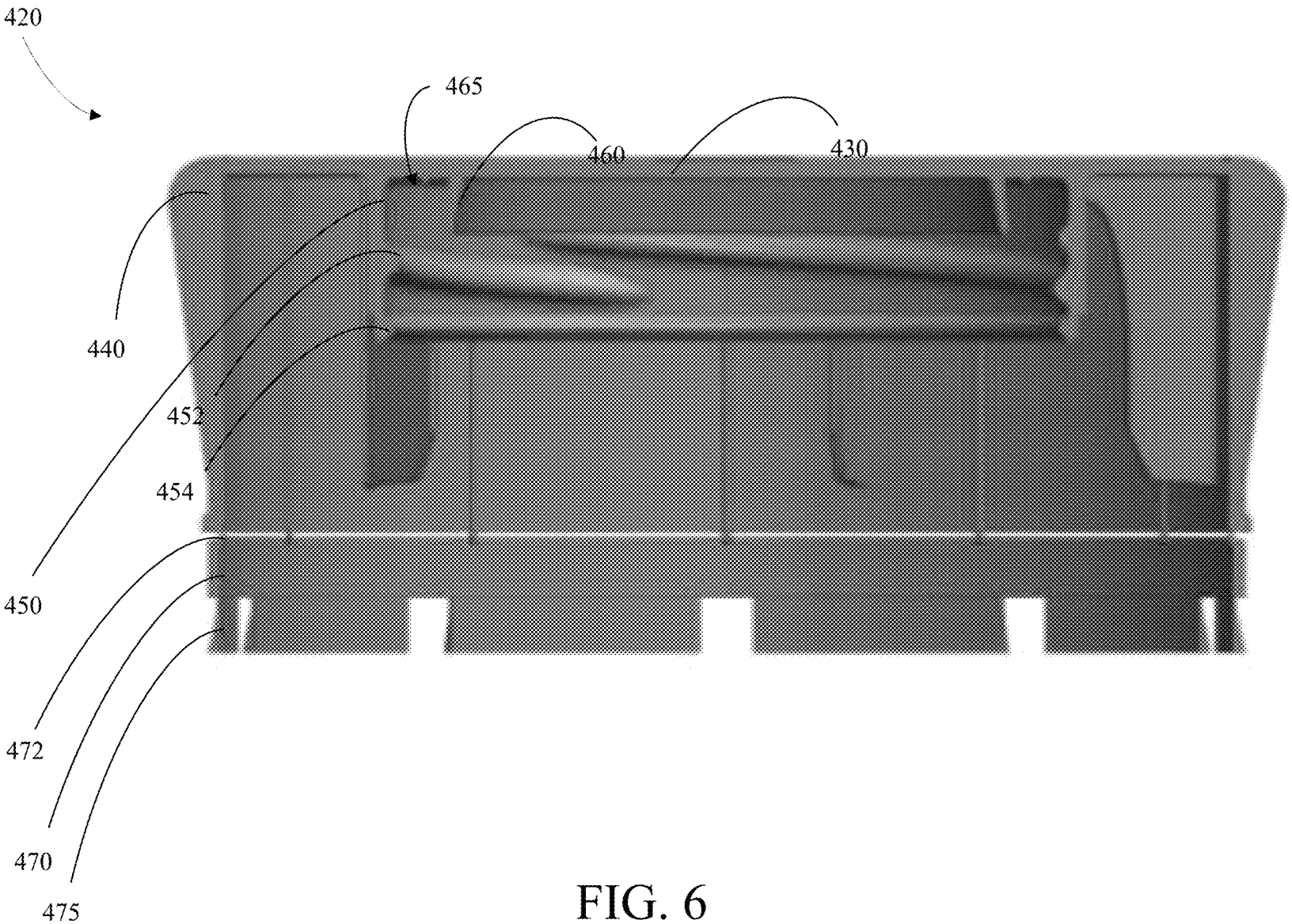
FIG. 6 is a cross-sectional view of foilless cap with tamper evident band of FIG. 4 in accordance with certain implementations.

As mentioned, the foilless and tamper evident cap 420 includes the tamper evident band 470 with is attached to the outer sidewall 440 via the tearable retaining elements 472. The tamper evident band 470 includes folding fingers 475 which are molded vertically downward (as shown in FIG. 6). The tamper evident band 470 and the folding fingers 475 are configured to fit in a hollow 409 formed below the retaining ring 407 and above the body 402. The folding fingers 475 retain the tamper evident band 470 on the container 400 after opening the foilless and tamper evident cap 420. The opening action tears the tearable retaining elements 472 and separates the tamper evident band 470 from the rest of the foilless and tamper evident cap 420. The use of the foilless and tamper evident cap 420 thus eliminates the foil seal, lining operations, label, and application operations.

FIG. 6 is a cross-sectional view of the foilless and tamper evident cap 420 of FIG. 4 and FIG. 5 in accordance with certain implementations. The folding fingers 475 are molded vertically downward.

Figure 7:
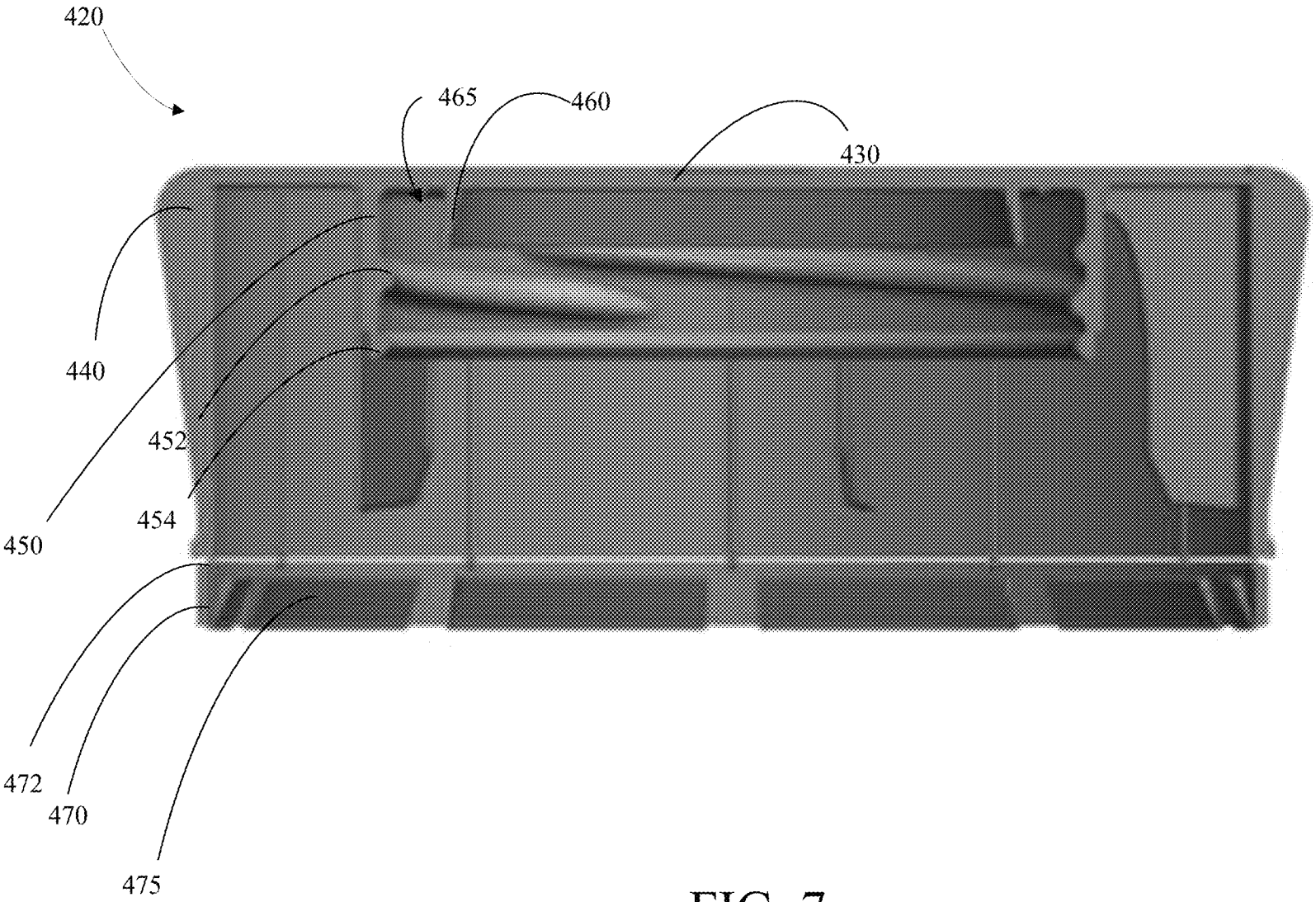
FIG. 7 is a cross-sectional view of foilless cap with tamper evident band of FIG. 4 in accordance with certain implementations.

FIG. 7 is a cross-sectional view of the foilless and tamper evident cap 420 of FIG. 4 and FIG. 5 in accordance with certain implementations. The folding fingers 475 are in a folded position when the foilless and tamper evident cap 420 is positioned on the container 400.

Figure 8:
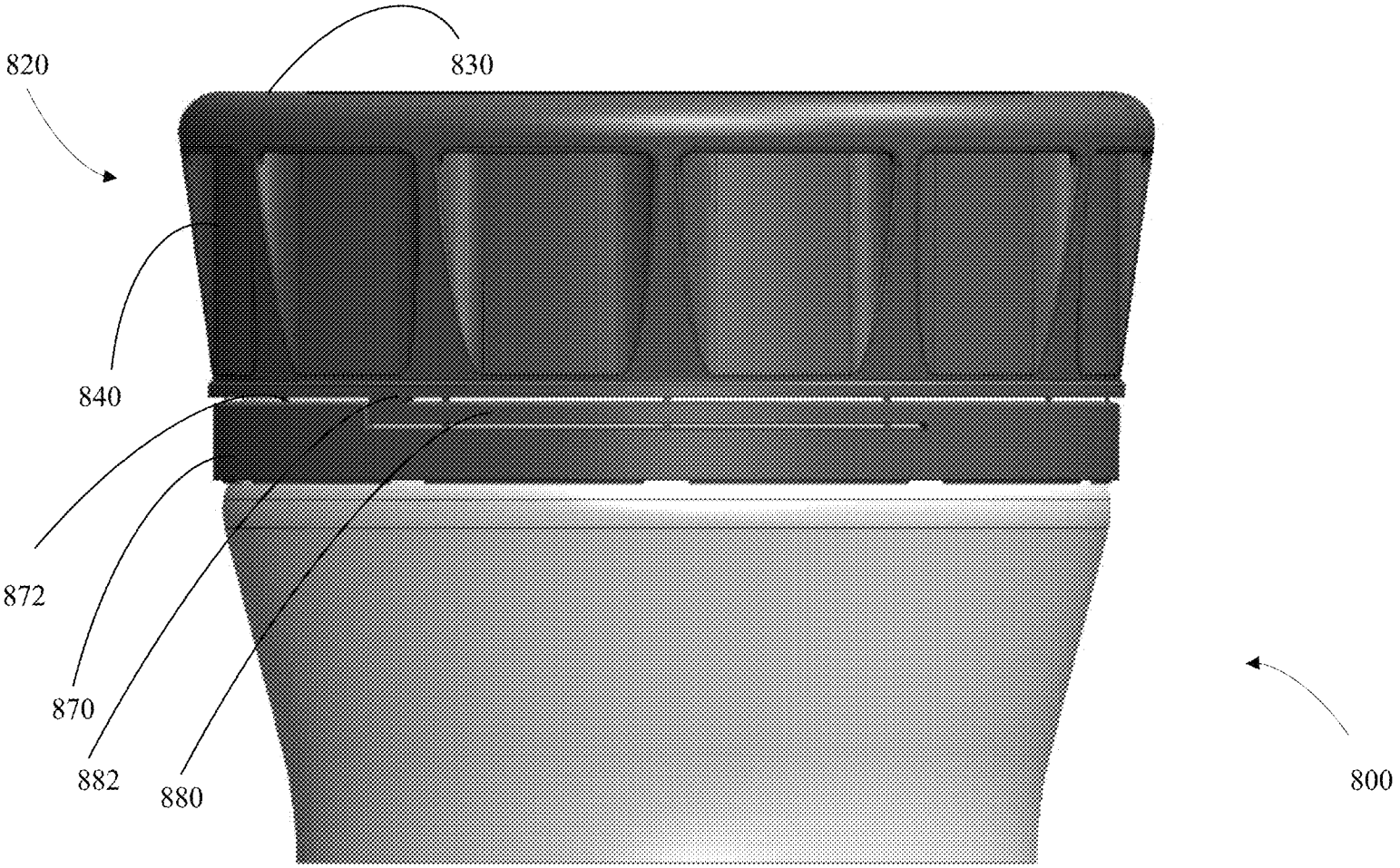
FIG. 8 is a foilless, tamper evident, and tethered cap in accordance with certain implementations.

FIG. 8 is a diagram of a container 800 with a foilless, tamper evident, and tethered cap 820 in a closed position in accordance with certain implementations. The foilless, tamper evident, and tethered cap 820 includes a base 830 and an outer sidewall 840. The foilless, tamper evident, and tethered cap 820 further includes a tamper evident band 870 with is attached to the outer sidewall 840 via tearable retaining elements 872. The tamper evident band 870 further includes a tether 880 which is attached via the tearable retaining elements 872. The tether 880 includes a wider non-tearable section 882 that is connected to the outer sidewall 840. The tether 880 may be in part implemented as described in U.S. Pat. No. 5,725,115, which issued Mar. 10, 1998, and herein is incorporated by reference in its entirety. In particular, U.S. Pat. No. 5,725,115 states the closure cap that is connected captively with the neck of a container. That this is done using a retaining ring which is used to engage beneath a bead on the container mouth when the cap is in position on the container mouth and that a cap wall is firmly connected with this retaining ring by the tether. The retaining ring also serves as an anti-tamper security for the closure. In a first condition, the tether runs between the cap wall and the retaining ring along the circumference of the closure cap and is connected by rupture bridge pieces with the retaining ring and the lower edge of the cap wall. Destruction of these rupture bridge pieces during fitting of the closure cap is prevented, and to ensure that the retaining ring holds firmly to the container mouth with the closure cap in position on the container mouth, the retaining ring is equipped with a plurality of tongues protruding radially inwards from its inner surface. The tongues being aligned upwards towards the cap base and engaging beneath the bead on the container mouth when the closure cap is in position on the container mouth.

Figure 9:
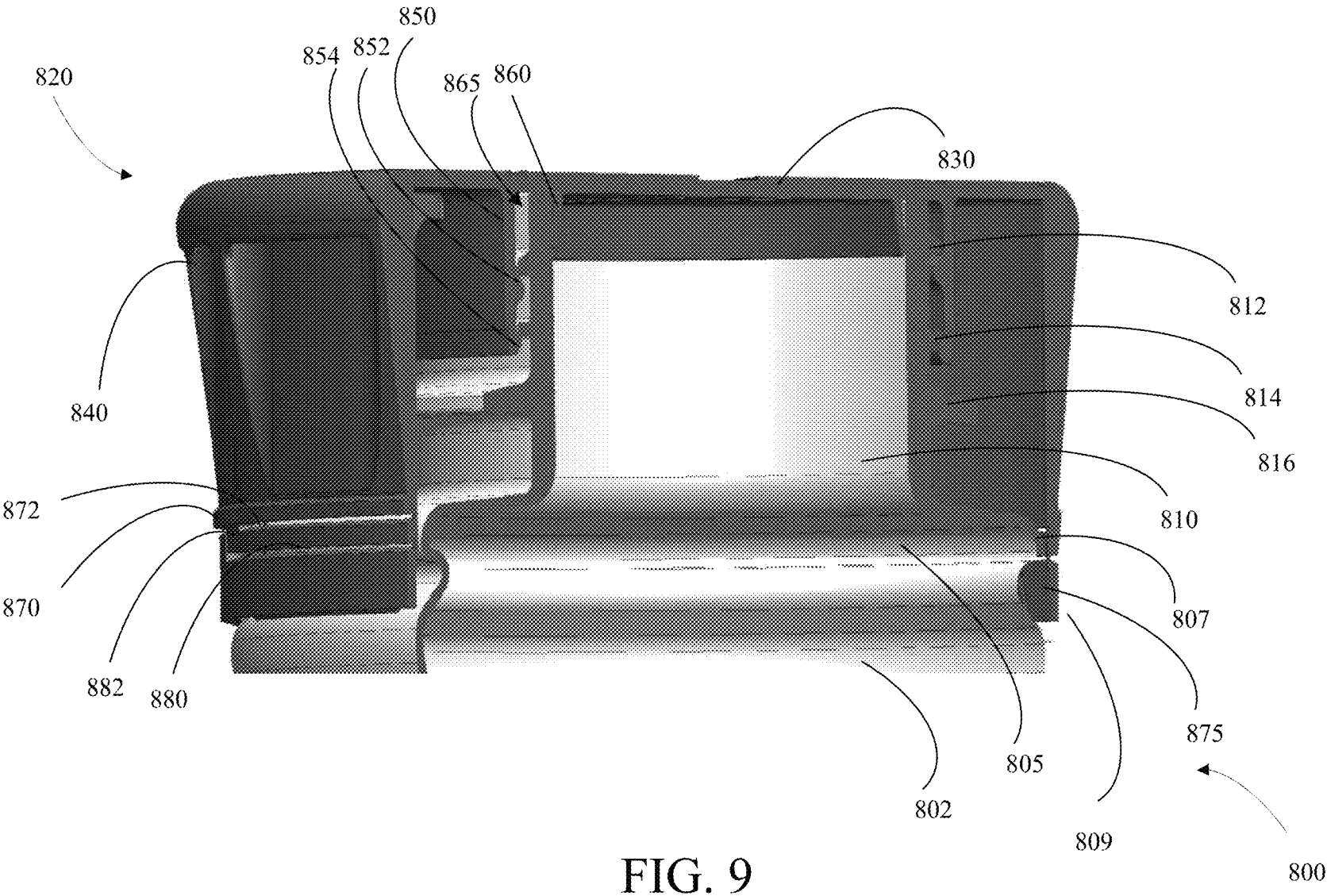
FIG. 9 is a cross-sectional view of the foilless and tethered cap of FIG. 8 in accordance with certain implementations.

FIG. 9 is a cross-sectional view of the container 800 and the foilless, tamper evident, and tethered cap 820 of FIG. 8 in accordance with certain implementations. The container 800 includes a body 802, a shoulder 805, and a neck 810. The neck 810 includes threads 812 and 814 and a collar 816, all of which face outward from the neck 810. The shoulder 805 includes a retaining ring 807.

The foilless, tamper evident, and tethered cap 820 includes the base 830, the outer sidewall 840, a middle sidewall 850, and an inner sidewall 860. The width and height of the base 830 and the outer sidewall 840 is dimensioned to accommodate the width of the shoulder 805 and the retaining ring 807 of the container 800 and the height of at least the neck 810 and the shoulder 805 of the container 800. The middle sidewall 850 has projections 852 and 854 which face toward the inner sidewall 860. The projections 852 and 854 of the middle sidewall 850 are shaped to diametrically interfere with and frictionally fit with the threads 812 and 814 of the container 800 to provide a non back-off mechanism which provides an audible and tactile indicator to a consumer or user that the container 800 is closed. The inner sidewall 860 is angled downward toward the middle sidewall 850 and configured to fit inside the neck 810 of the container 800. The middle sidewall 850 and the inner sidewall 860 thus form a V-shaped groove 865 which is designed to engage the neck 810 of the container 800 and provide a linerless plug seal for the container 800. The foilless, tamper evident, and tethered cap 820 thus eliminates the foil seal and lining operations.

As mentioned, the foilless, tamper evident, and tethered cap 820 includes the tamper evident band 870 with is attached to the outer sidewall 840 via the tearable retaining elements 872. The tamper evident band 870 includes folding fingers 875 which are molded vertically downward. The tamper evident band 870 and folding fingers 875 are configured to fit in a hollow 809 formed below the retaining ring 807 and above the body 802. The folding fingers 875 retain the tamper evident band 875 on the container 800 after opening the foilless, tamper evident, and tethered cap 820. The opening action tears the tearable retaining elements 872 and separates a portion of the tamper evident band 870 from the rest of the foilless, tamper evident, and tethered cap 820.

The use of the foilless, tamper evident, and tethered cap 820 thus eliminates the foil seal, lining operations, label, and application operations.

As mentioned, the tamper evident band 870 further includes the tether 880 which is attached via the tearable retaining elements 872. The tether 880 includes the wider non-tearable section 882 that is connected to the outer sidewall 840. The opening action does not tear the wider non-tearable section 882 and tether 880 retains the foilless, tamper evident, and tethered cap 820 and keeps the foilless, tamper evident, and tethered cap 820 away from a mouth of the container 800 by a length of the tether 880. The use of the foilless, tamper evident, and tethered cap 820 thus eliminates the foil seal, lining operations, label, application operations, and retains the foilless, tamper evident, and tethered cap 820 to the container 800.

Figure 10:
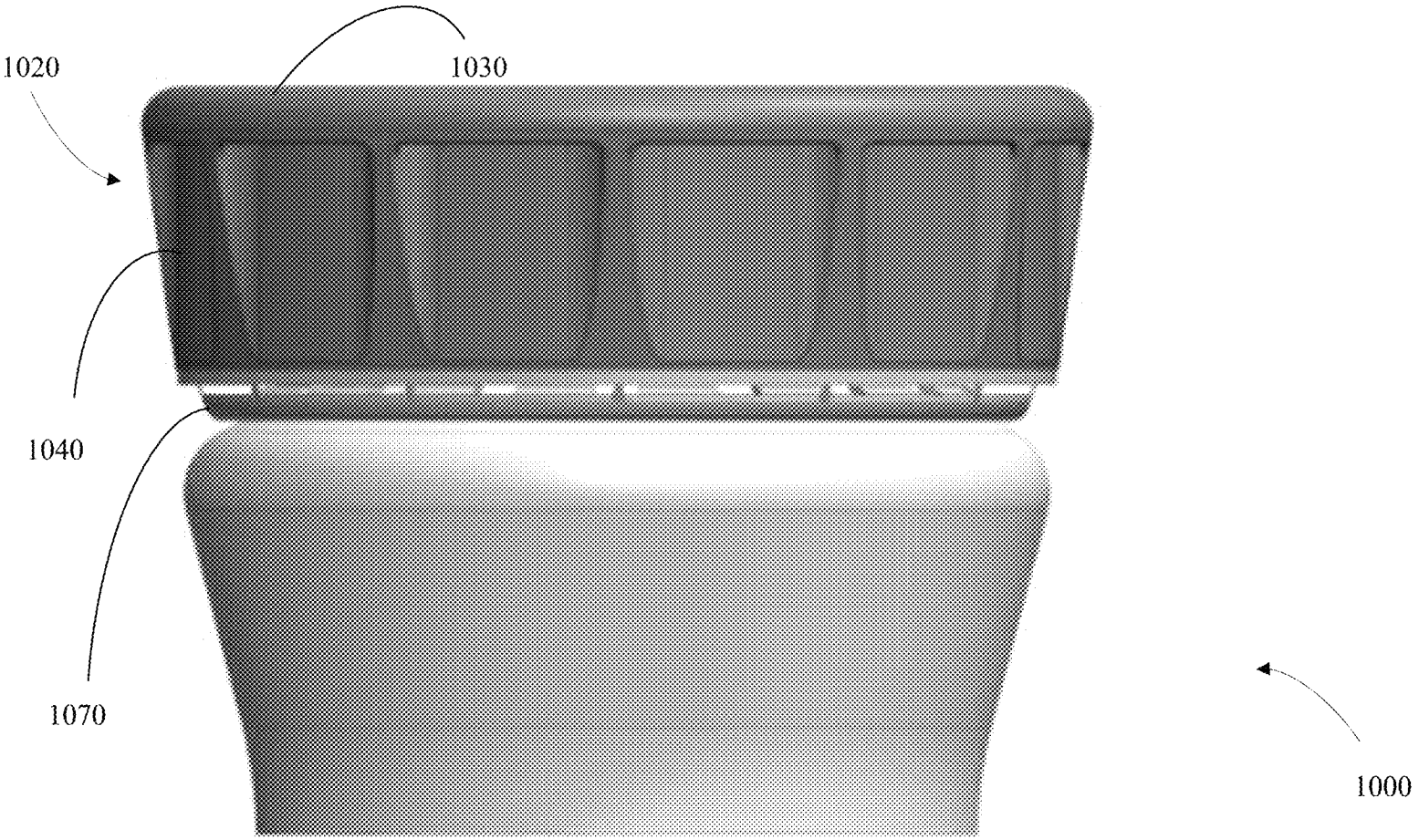
FIG. 10 is a foilless cap with tamper evident ring adapter in accordance with certain implementations.

FIG. 10 is a diagram of a container 1000 with a foilless and tamper evident cap 1020 in a closed position in accordance with certain implementations. The foilless and tamper evident cap 1020 includes a base 1030 and an outer sidewall 1040. The foilless and tamper evident cap 1020 further includes a tamper evident ring adapter 1070 with is snapped or molded to the outer sidewall 1040.

Figure 11:
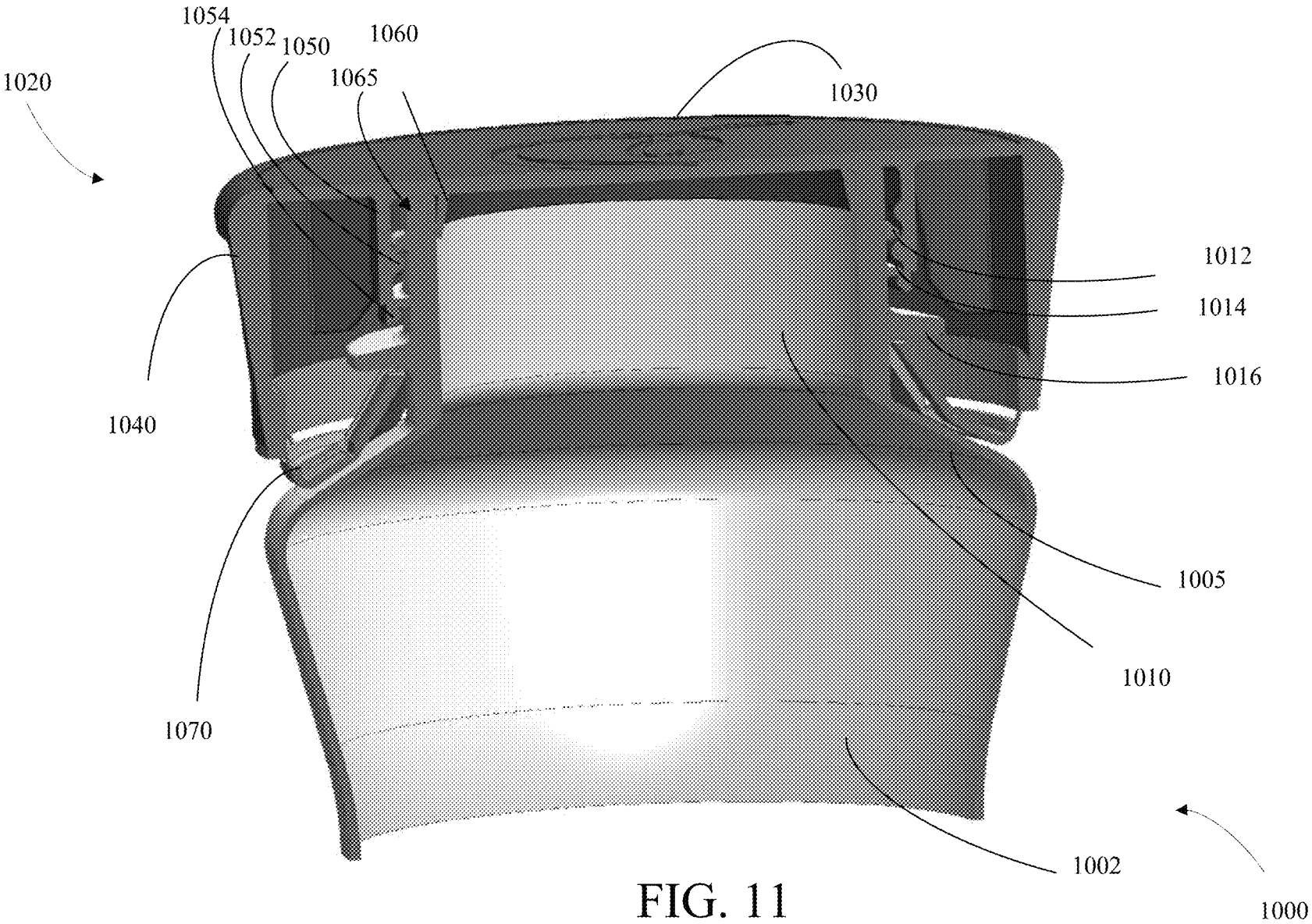
FIG. 11 is a cross-sectional view of the foilless cap with tamper evident ring adapter of FIG. 10 in accordance with certain implementations.

FIG. 11 is a cross-sectional view of the container 1000 and the foilless and tamper evident cap 1020 of FIG. 10 in accordance with certain implementations. The container 1000 includes a body 1002, a shoulder 1005, and a neck 1010. The neck 1010 includes threads 1012 and 1014 and a collar 1016 (e.g., a collar spaced apart from the threads 1012 and 1014), all of which face and/or may be extending outward from the neck 1010.

The foilless and tamper evident cap 1020 includes the base 1030, the outer sidewall 1040, a middle sidewall 1050, and an inner sidewall 1060. The width and height of the outer sidewall 1040 and the base 1030 is dimensioned to accommodate the width of the shoulder of the container 1000 and the height of at least the neck 1010 and the shoulder 1005 of the container 1000. The middle sidewall 1050 has projections 1052 and 1054 which face toward the inner sidewall 1060. The projections 1052 and 1054 of the middle sidewall 1050 are shaped to diametrically interfere with and frictionally fit with the threads 1012 and 1014 of the container 1000 to provide a non back-off mechanism which provides an audible and tactile indicator to a consumer or user that the container 1000 is closed. The inner sidewall 1060 is angled downward toward the middle sidewall 1050 and configured to fit inside the neck 1010 of the container 1000. The middle sidewall 1050 and the inner sidewall 1060 thus form a V-shaped groove 1065 which is designed to engage the neck 1010 of the container 1000 and provide a linerless plug seal for the container 1000. The foilless and tamper evident cap 1020 thus eliminates the foil seal and lining operations.

As mentioned, the foilless and tamper evident cap 1020 includes the tamper evident ring adapter 1070 with is snapped or molded to the outer sidewall 1040. The tamper evident ring adapter 1070 is configured to fit below the collar 1016 and above the shoulder 1005. The tamper evident ring adapter 1070 remains on the container 1000 after opening the foilless and tamper evident cap 1020. The opening action breaks the tamper evident ring adapter 1070 from the outer sidewall 1040 and separates the tamper evident ring adapter 1070 from the rest of the foilless and tamper evident cap 1020. The use of the foilless and tamper evident cap 1020 thus eliminates the foil seal, label, application operations, and slitting operations while moving the tamper evident mechanisms to the cap mold. The tamper evident ring adapter 1070 is low cost and assembles after closure molding with the lining operation.

Figure 12:
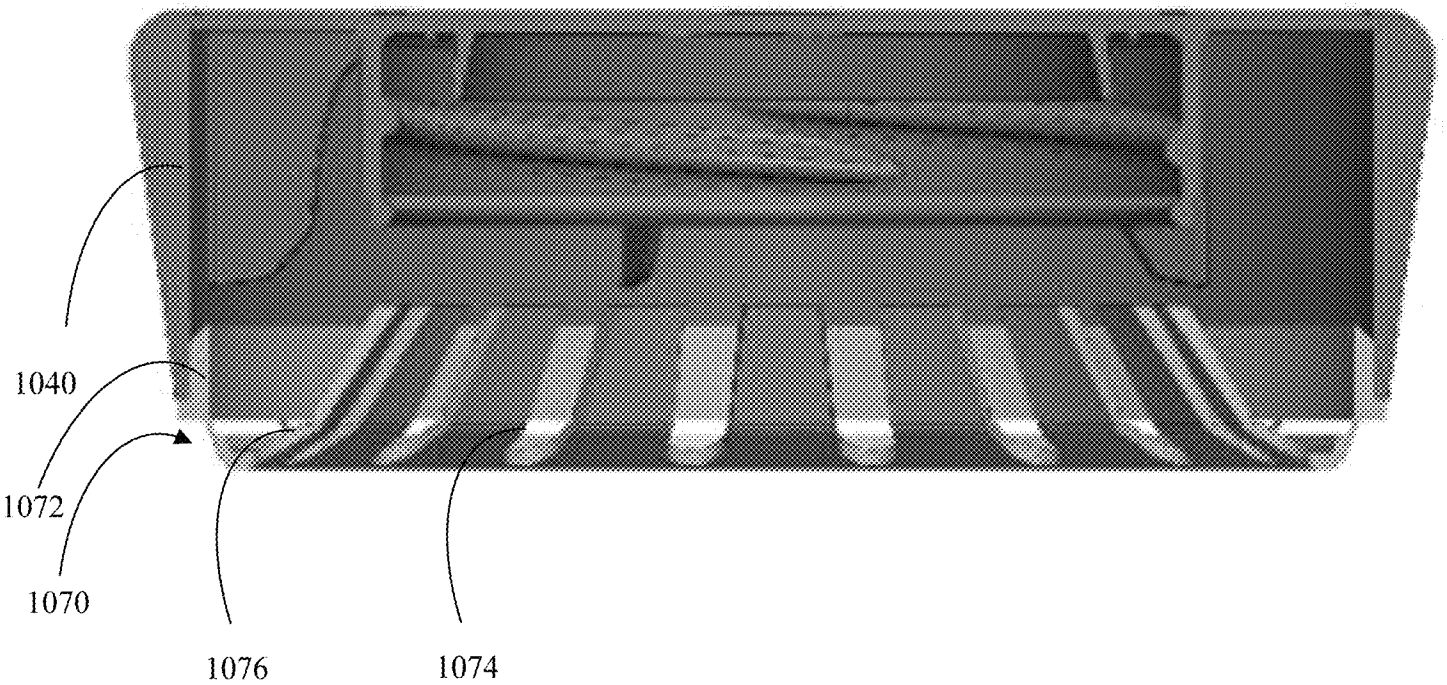
FIG. 12 is a cross-sectional view of the foilless cap with tamper evident ring adapter of FIG. 10 in accordance with certain implementations.

FIG. 12 is a cross-sectional view of the foilless and tamper evident cap 1020 of FIG. 10 and FIG. 11 in accordance with certain implementations. Certain elements which are illustrated in FIG. 10 and FIG. 11 are not labeled in FIG. 12 for purposes of clarity. In particular the tamper evident ring adapter 1070 is shown snapped or molded to the outer sidewall 1040 in a non-used condition. The tamper evident ring adapter 1070 includes a wall 1072 which snap fits or is molded (e.g., integrally molded) to the outer sidewall 1040 (e.g., snap fit or molded such that the wall 1072 is located at least partially internal to the outer sidewall 1040). The tamper evident ring adapter 1070 can include multiple fingers 1074 which extend (e.g., extend upward beyond a top edge of the wall 1072) and engage with the collar 1016 and the neck 1010 of the container 1000. The multiple fingers 1074 are connected to the wall 1072 via tearable elements 1076 located therebetween.

Figure 13:
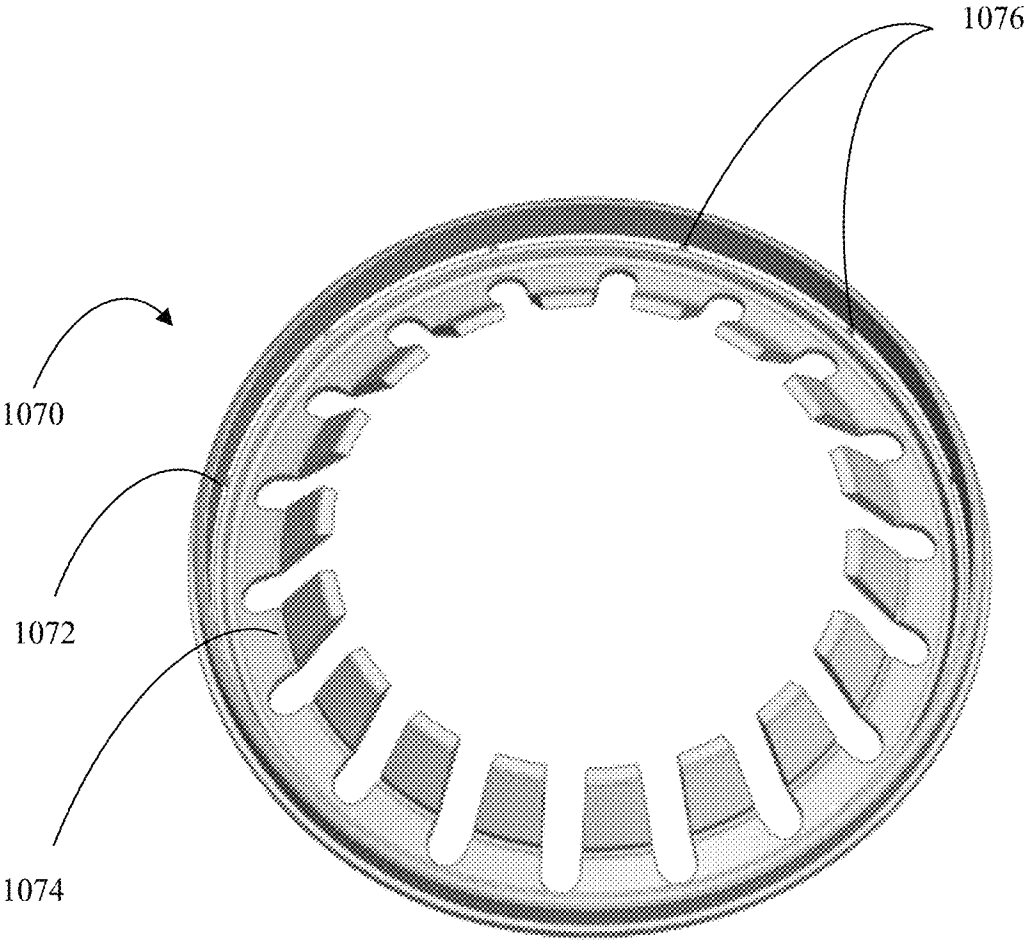
FIG. 13 is the tamper evident ring adapter of FIG. 10 in accordance with certain implementations.

FIG. 13 is a diagram of the tamper evident ring adapter 1070 of FIG. 10, FIG. 11 and FIG. 12 in accordance with certain implementations. Certain elements which are illustrated in FIG. 10. FIG. 11 and FIG. 12 are not labeled in FIG. 13 for purposes of clarity. In particular the tamper evident ring adapter 1070 includes a wall 1072 which snap fits or is molded to the outer sidewall 1040. The tamper evident ring adapter 1070 also includes multiple fingers 1074 which engage with the collar 1016 and the neck 1010 of the container 1000. The multiple fingers 1074 are connected to the wall 1072 via tearable elements 1076.

Figure 14:
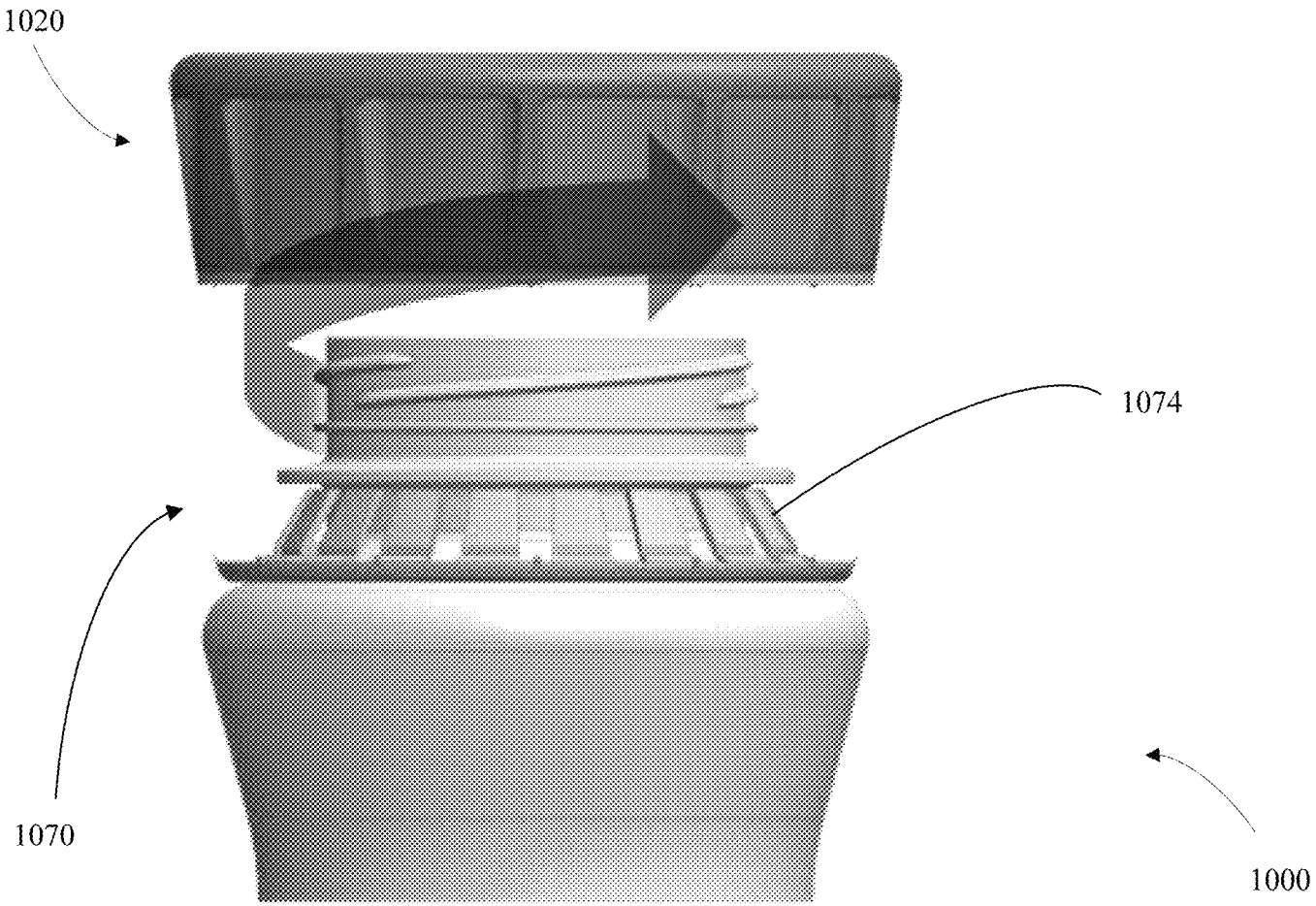
FIG. 14 is an opening diagram of the foilless cap with tamper evident ring adapter of FIG. 10 in accordance with certain implementations.

FIG. 14 is a diagram of the container 1000 and the foilless and tamper evident cap 1020 of FIG. 10, FIG. 11, FIG. 12, and FIG. 13 in accordance with certain implementations. Certain elements which are illustrated in FIG. 10. FIG. 11, FIG. 12 and FIG. 13 are not labeled in FIG. 14 for purposes of clarity. In particular, when the foilless and tamper evident cap 1020 is twisted open from the container 1000, the multiple fingers 1074 of the tamper evident ring adapter 1070 remains on the container 1000 and the wall 1072 (not shown) remains with the foilless and tamper evident cap 1020. The use of the foilless and tamper evident cap 1020 thus eliminates the foil seal, lining operations, label, and application operations.

Figure 15:
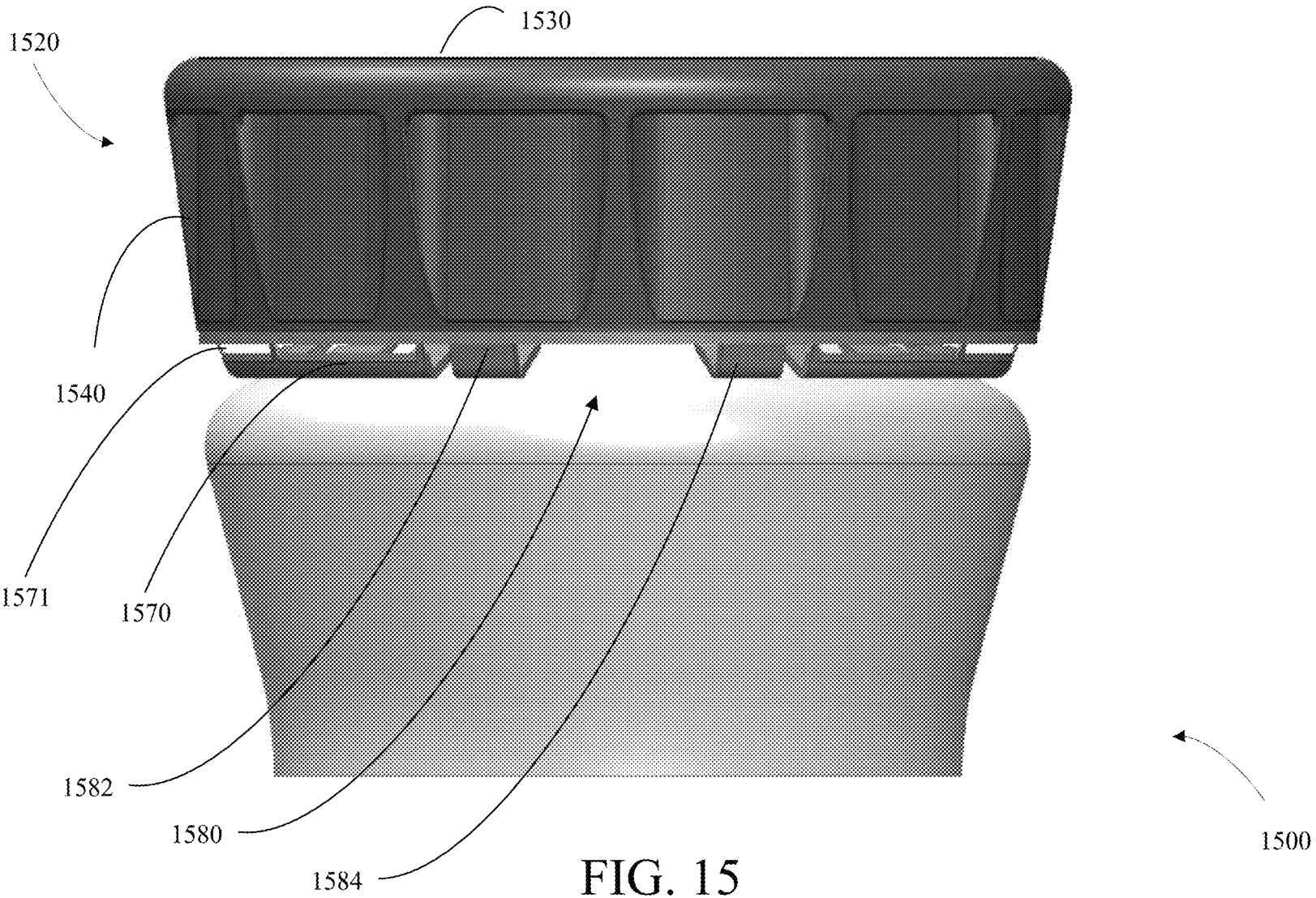
FIG. 15 is a foilless and tethered cap with a tamper evident ring adapter in accordance with certain implementations.

FIG. 15 is a diagram of a container 1500 with a foilless, tamper evident, and tethered cap 1520 in a closed position in accordance with certain implementations. The foilless, tamper evident, and tethered cap 1520 includes a base 1530 and an outer sidewall 1540. The foilless, tamper evident, and tethered cap 1520 further includes a tamper evident ring adapter 1570 that is attached to the outer sidewall 1540 via tearable retaining elements 1571. The tamper evident ring adapter 1570 further includes a tether mechanism 1580, which includes a hinge 1582 and a hinge 1584.

Figure 16:
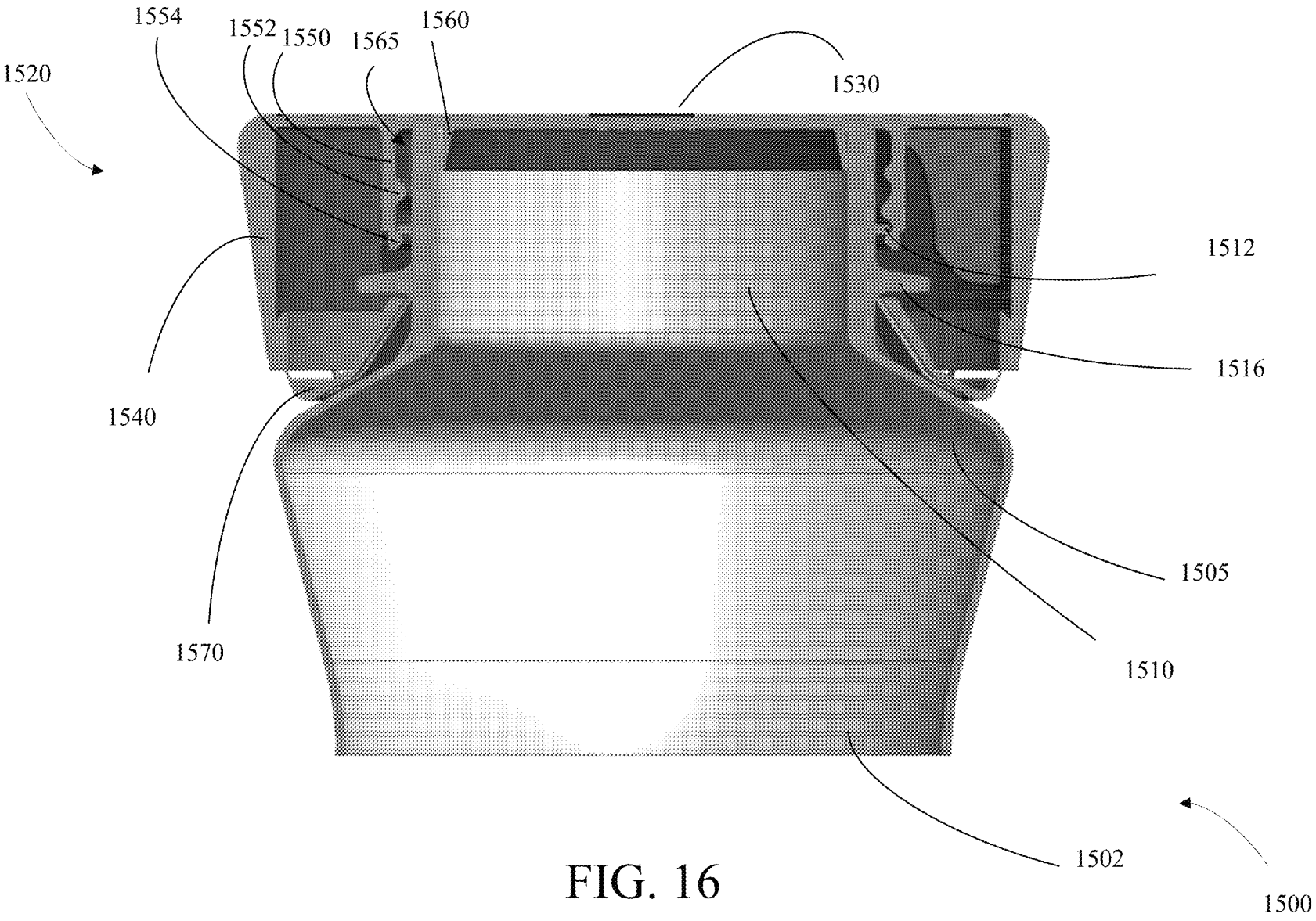
FIG. 16 is a cross-sectional view of the foilless and tethered cap with a tamper evident ring adapter of FIG. 15 in accordance with certain implementations.

FIG. 16 is a cross-sectional view of the container 1500 and the foilless, tamper evident, and tethered cap 1520 of FIG. 15 in accordance with certain implementations. The container 1500 includes a body 1502, a shoulder 1505, and a neck 1510. The neck 1510 includes threads 1512 and a collar 1516, all of which face outward from the neck 1510.

The foilless, tamper evident, and tethered cap 1520 includes the base 1530, the outer sidewall 1540, a middle sidewall 1550, and an inner sidewall 1560. The width and height of the outer sidewall 1540 and the base 1530 is dimensioned to accommodate the width of the shoulder 1505 of the container 1500 and the height of at least the neck 1510 and the shoulder 1505 of the container 1500. The middle sidewall 1550 has projections 1552 and 1554 which face toward the inner sidewall 1560. The projections 1554 of the middle sidewall 1550 are shaped to diametrically interfere with and frictionally fit with the threads 1512 of the container 1500 to provide a non back-off mechanism which provides an audible and tactile indicator to a consumer or user that the container 1500 is closed. The inner sidewall 1560 is angled downward toward the middle sidewall 1550 and configured to fit inside the neck 1510 of the container 1500. The middle sidewall 1550 and the inner sidewall 1560 thus form a V-shaped groove 1565 which is designed to engage the neck 1510 of the container 1500 and provide a linerless plug seal for the container 1500. The foilless, tamper evident, and tethered cap 1520 thus eliminates the foil seal and lining operations.

As mentioned, the foilless, tamper evident, and tethered cap 1520 includes the tamper evident ring adapter 1570 with is snapped or molded to the outer sidewall 1540. The tamper evident ring adapter 1570 is configured to fit below the collar 1516 and above the shoulder 1505. The tamper evident ring adapter 1570 remains on the container 1500 after opening the foilless, tamper evident, and tethered cap 1520. The opening action breaks the tamper evident ring adapter 1570 from the outer sidewall 1540 and separates a portion of the tamper evident ring adapter 1570 from the rest of the foilless, tamper evident, and tethered cap 1520. The use of the foilless, tamper evident, and tethered cap 1520 thus eliminates the foil seal, label, application operations, and slitting operations while moving the tamper evident mechanisms to the cap mold. The tamper evident ring adapter 1570 is low cost and assembles after closure molding with the lining operation.

Figure 17:
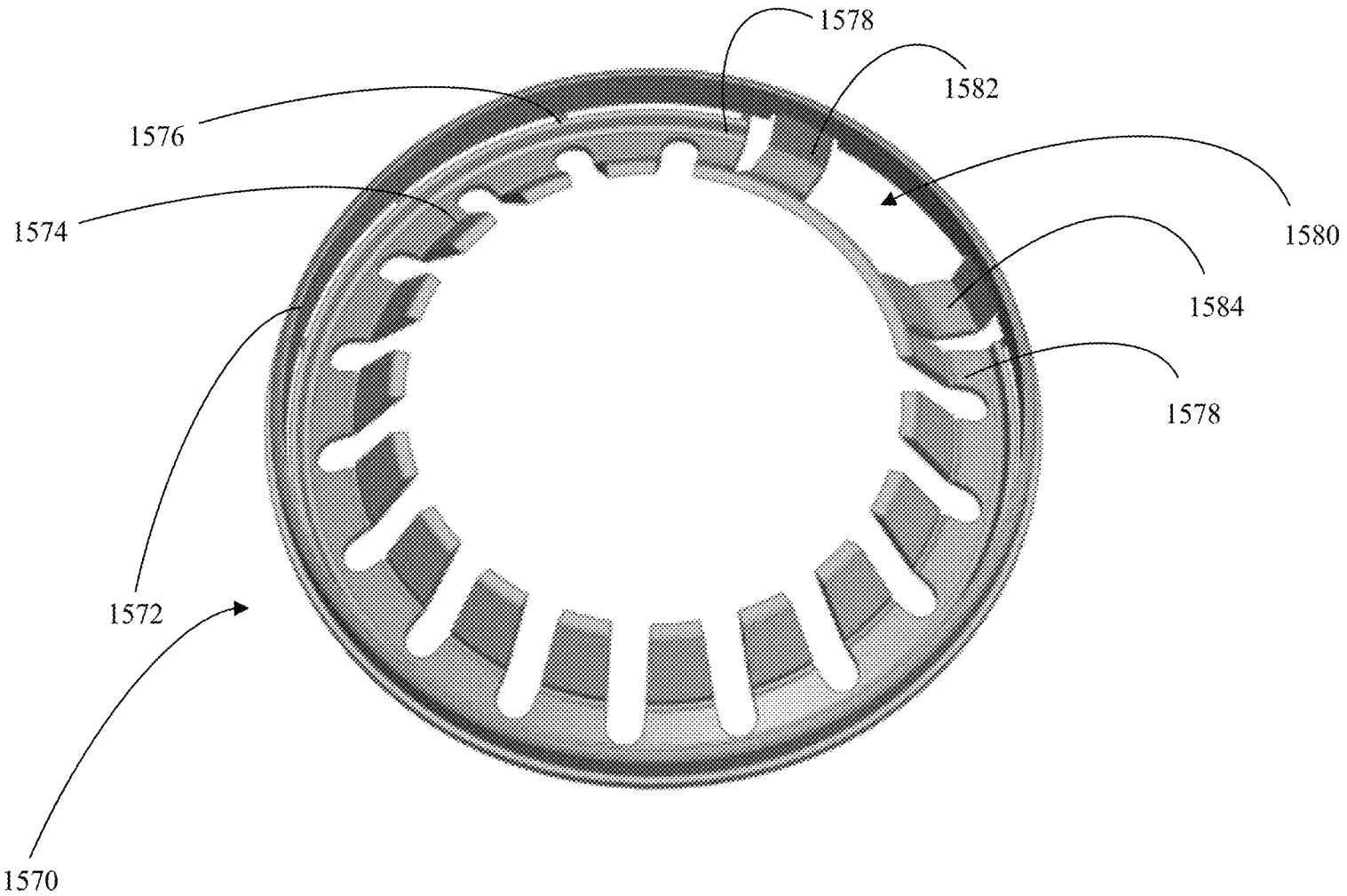
FIG. 17 is the tamper evident ring adapter of FIG. 15 in accordance with certain implementations.

As mentioned, the tamper evident ring adapter 1570 includes the tether mechanism 1580. This is shown more clearly in FIG. 17, which shows the tamper evident ring adapter 1570 of FIG. 15 in accordance with certain implementations. The tamper evident ring adapter 1570 includes a wall 1572 which snap fits or is molded to the outer sidewall 1540. In implementations, adhesive can be used. In implementations, molded can include bonded or fused. The tamper evident ring adapter 1570 also includes multiple fingers 1574 which engage with the collar 1516 and the neck 1510 of the container 1500. The multiple fingers 1574 are connected to the wall 1572 via tearable elements 1576. The tamper evident ring adapter 1570 further includes the tether mechanism 1580. The tether mechanism 1580 includes a hinge 1582 and a hinge 1584. The hinge 1582 is connected to finger 1576 and to the wall 1572. The hinge 1584 is connected to a finger 1578 and to the wall 1572. The tether mechanism 1580 tethers the foilless, tamper evident, and tethered cap 1520 on the container 1500 after opening the foilless, tamper evident, and tethered cap 1520. The opening action breaks the tamper evident ring adapter 1570 from the outer sidewall 1540 and separates the tamper evident ring adapter 1570 from the rest of the foilless, tamper evident, and tethered cap 1520 but does not tear the hinges 1582 and 1584. The hinges 1582 and 1584 use over center spring action to create bi-stable, stay-back positions of the foilless, tamper evident, and tethered cap 1520. The use of the foilless, tamper evident, and tethered cap 1520 thus eliminates the foil seal, label, application operations, and slitting operations while moving the tamper evident mechanisms to the cap mold and retains the foilless, tamper evident, and tethered cap 1520 to the container 1500. The tamper evident ring adapter 1570 is low cost and assembles after closure molding with the lining operation.

Figure 18:
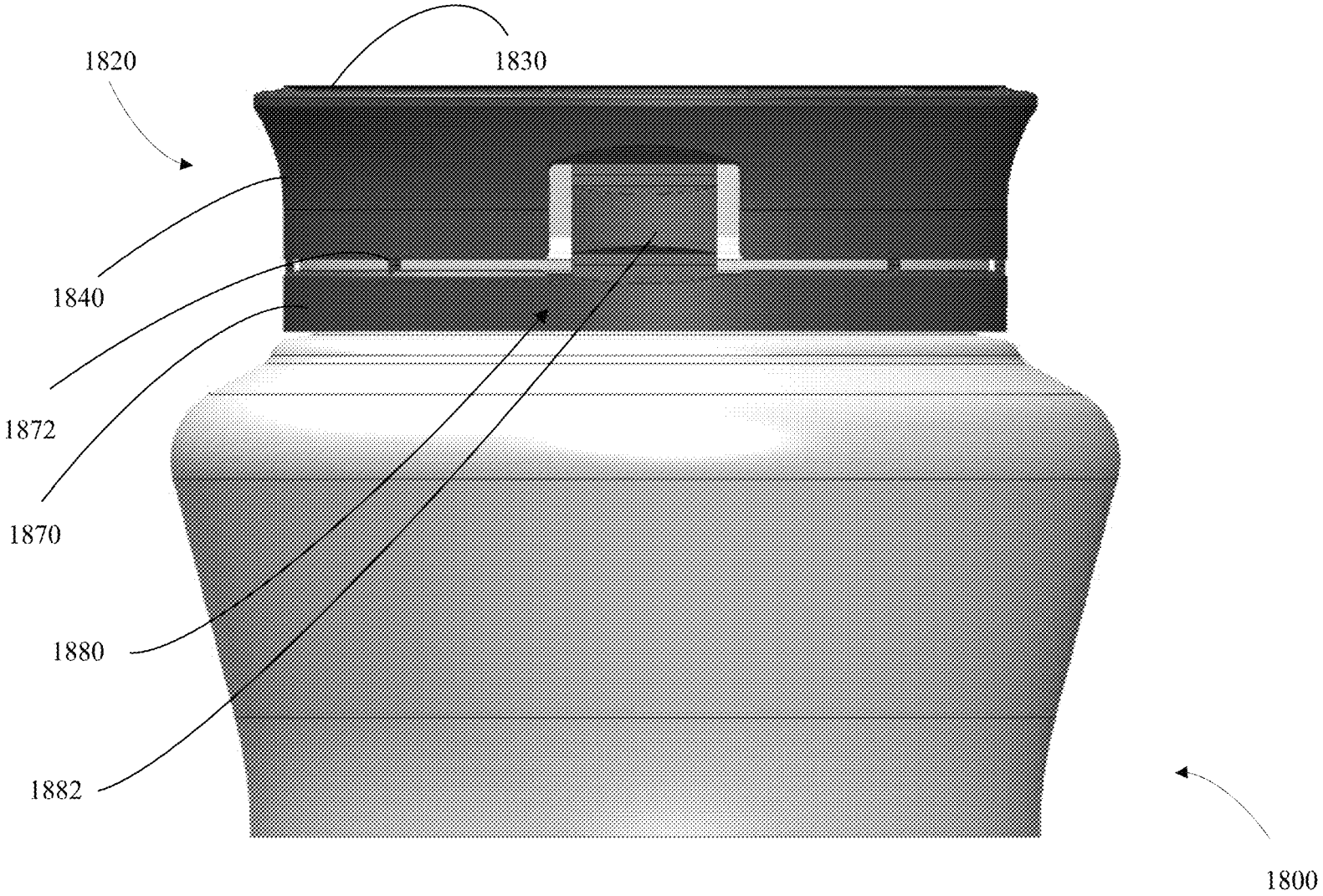
FIG. 18 is a view of a foilless and tethered cap with bi-hinge mechanism in accordance with certain implementations.

FIG. 18 is a diagram of a container 1800 with a foilless, tamper evident, and tethered cap 1820 in a closed position in accordance with certain implementations. The foilless, tamper evident, and tethered cap 1820 includes a base 1830 and an outer sidewall 1840. The foilless, tamper evident, and tethered cap 1820 further includes a tamper evident band 1870 with is attached to the outer sidewall 1854 via tearable retaining elements 1872. The tamper evident band 1870 further includes a tether mechanism 1880 which is a hinge 1882 connected to the outer sidewall 1840 and the tamper evident band 1870.

Figure 19:
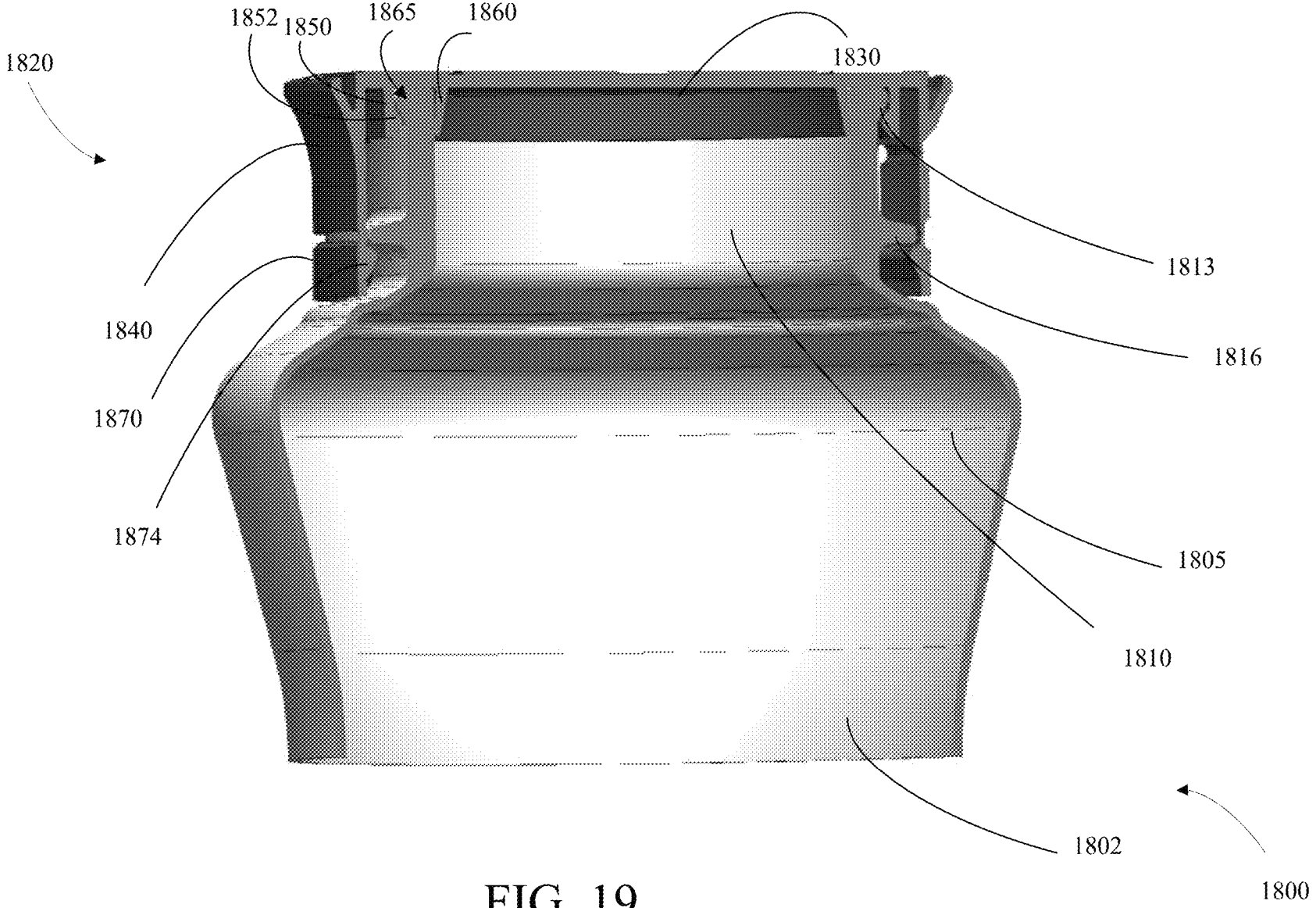
FIG. 19 is a cross-sectional view of the foilless and tethered cap of FIG. 18 in accordance with certain implementations.

FIG. 19 is a cross-sectional view of the container 1800 and the foilless, tamper evident, and tethered cap 1820 of FIG. 18 in accordance with certain implementations. The container 1800 includes a body 1802, a shoulder 1805, and a neck 1810. The neck 1810 includes a lip 1813 and a collar 1816, all of which face outward from the neck 1810.

The foilless, tamper evident, and tethered cap 1820 includes the base 1830, the outer sidewall 1840, a middle sidewall 1850, and an inner sidewall 1860. The width and height of the outer sidewall 1840 and the base 1830 is dimensioned to accommodate the width of the neck 1810 of the container 1800 and the height of at least the collar 1816 of the neck 1810. The middle sidewall 1850 has a projection 1852 which faces toward the inner sidewall 1860. The projection 1852 of the middle sidewall 1850 is shaped to diametrically interfere with and frictionally fit with the lip 1813 of the container 1800 to provide a non back-off mechanism which provides an audible and tactile indicator to a consumer or user that the container 1800 is closed. The inner sidewall 1860 is angled downward toward the middle sidewall 1850 and configured to fit inside the neck 1810 of the container 1800. The middle sidewall 1850 and the inner sidewall 1860 thus form a V-shaped groove 1865, which is designed to engage the neck 1810 of the container 1800 and provide a linerless plug seal for the container 1800. The foilless, tamper evident, and tethered cap 1820 thus eliminates the foil seal and lining operations.

As mentioned, the foilless, tamper evident, and tethered cap 1820 includes the tamper evident band 1870 which is connected to the outer sidewall 1840 via the tearable retaining elements 1872 (as shown in FIG. 18). The tamper evident band 1570 includes a projection 1574 which is configured to fit below the collar 1816 and or and above the shoulder 1805. The tamper evident band 1870 remains on the container 1800 after opening the foilless, tamper evident, and tethered cap 1820. The opening action breaks the tamper evident band 1870 from the outer sidewall 1840 and separates a portion of the tamper evident band 1870 from the rest of the foilless, tamper evident, and tethered cap 1820. The use of the foilless, tamper evident, and tethered cap 1820 thus eliminates the foil seal, label, and application operations.

Figure 20:
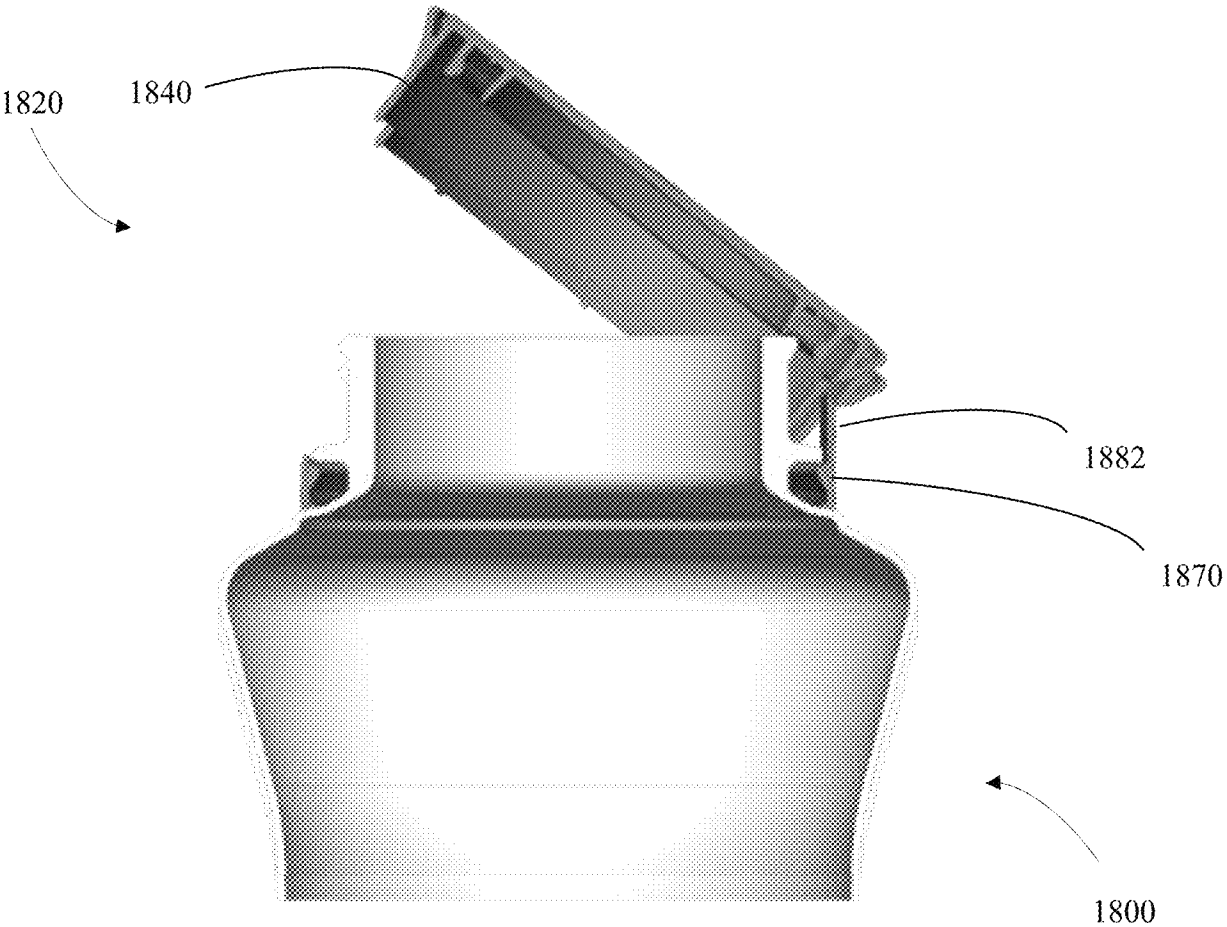
FIG. 20 is a view of the foilless and tethered cap of FIG. 18 in a starting to open position in accordance with certain implementations.
Figure 21:
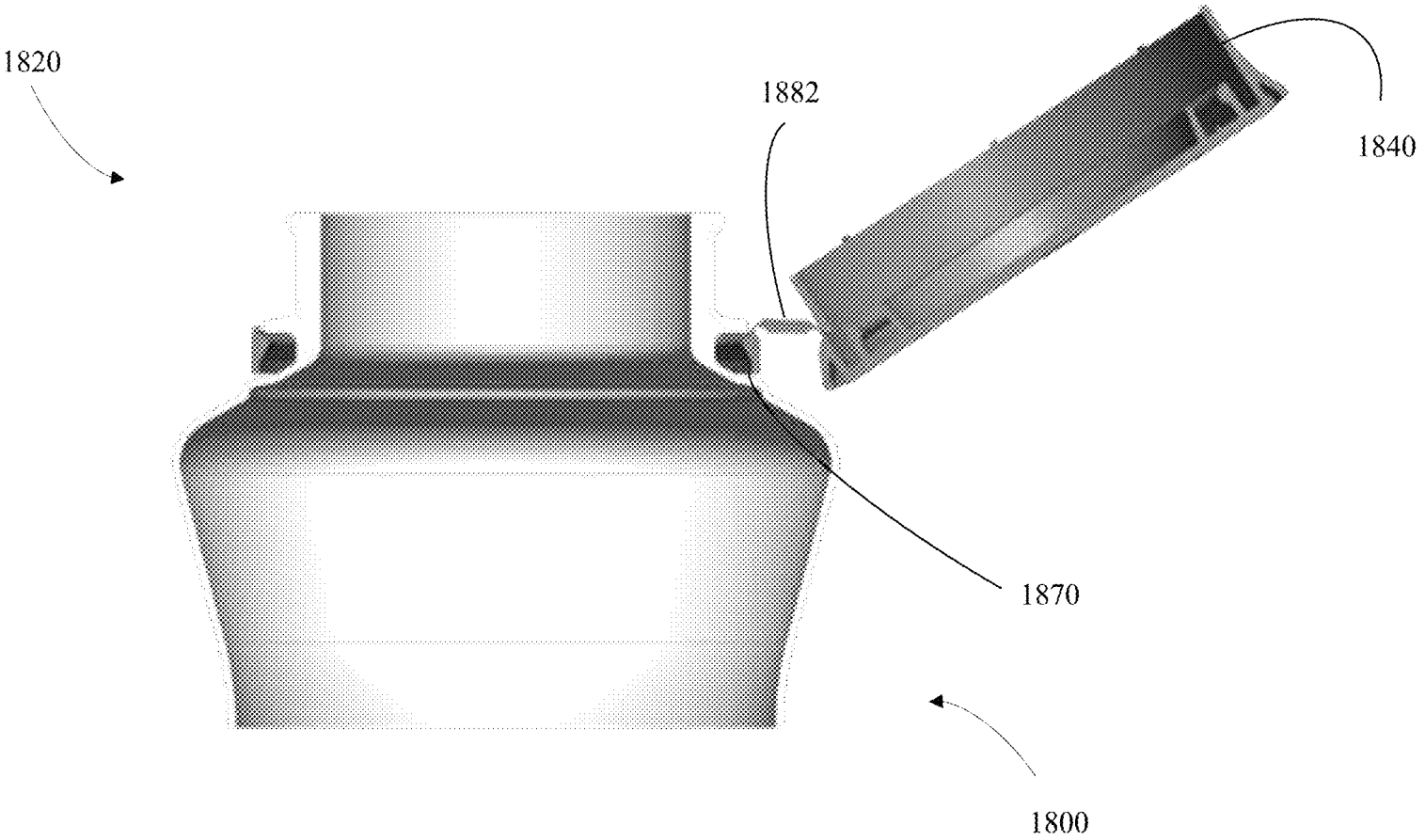
FIG. 21 is a view of the foilless and tethered cap of FIG. 18 in a fully open position in accordance with certain implementations.

As mentioned, the tamper evident band 1870 includes the tether mechanism 1880. This is shown more clearly with respect to FIG. 18, FIG. 20 and FIG. 21, where FIG. 20 and FIG. 21 show opening of the foilless, tamper evident, and tethered cap 1820 from the container 1800. The tether mechanism 1880 includes the hinge 1882 which is connected to the outer sidewall 1840 and the tamper evident band 1870. The hinge 1882 tethers the foilless, tamper evident, and tethered cap 1820 on the container 1800 after opening the foilless, tamper evident, and tethered cap 1820. The opening action breaks the tamper evident band 1870 from the outer sidewall 1840 and separates the tamper evident band 1870 from the rest of the foilless, tamper evident, and tethered cap 1820 but does not tear the hinge 1882. The hinge 1882 uses an over center spring action to create bi-stable, stay-back positions of the foilless, tamper evident, and tethered cap 1820. The use of the foilless, tamper evident, and tethered cap 1820 thus eliminates the foil seal, label, and application operations, and retains the foilless, tamper evident, and tethered cap 1820 to the container 1800.

Figure 22:
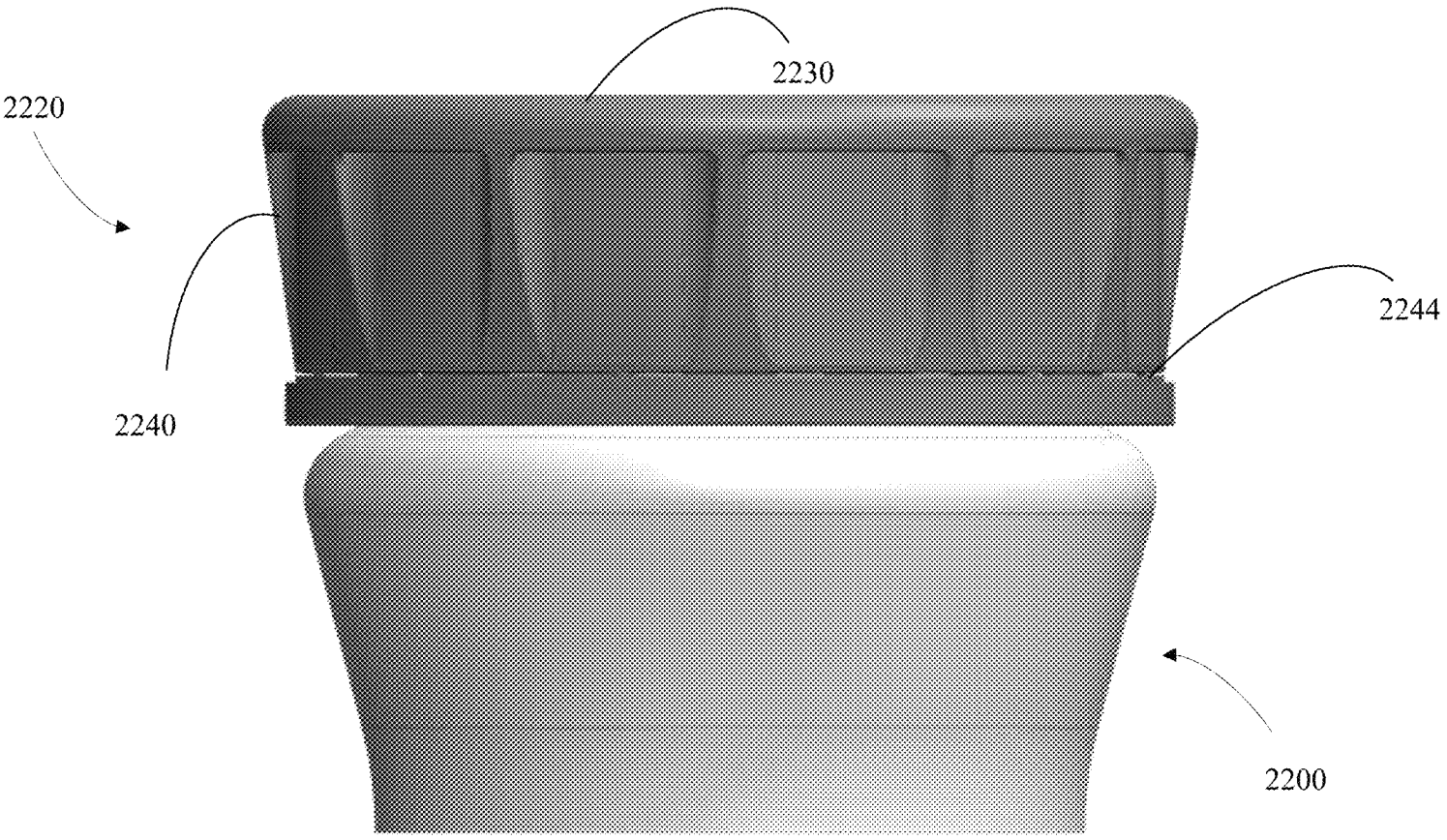
FIG. 22 is a foilless cap with tamper evident ring adapter in accordance with certain implementations.
Figure 24:
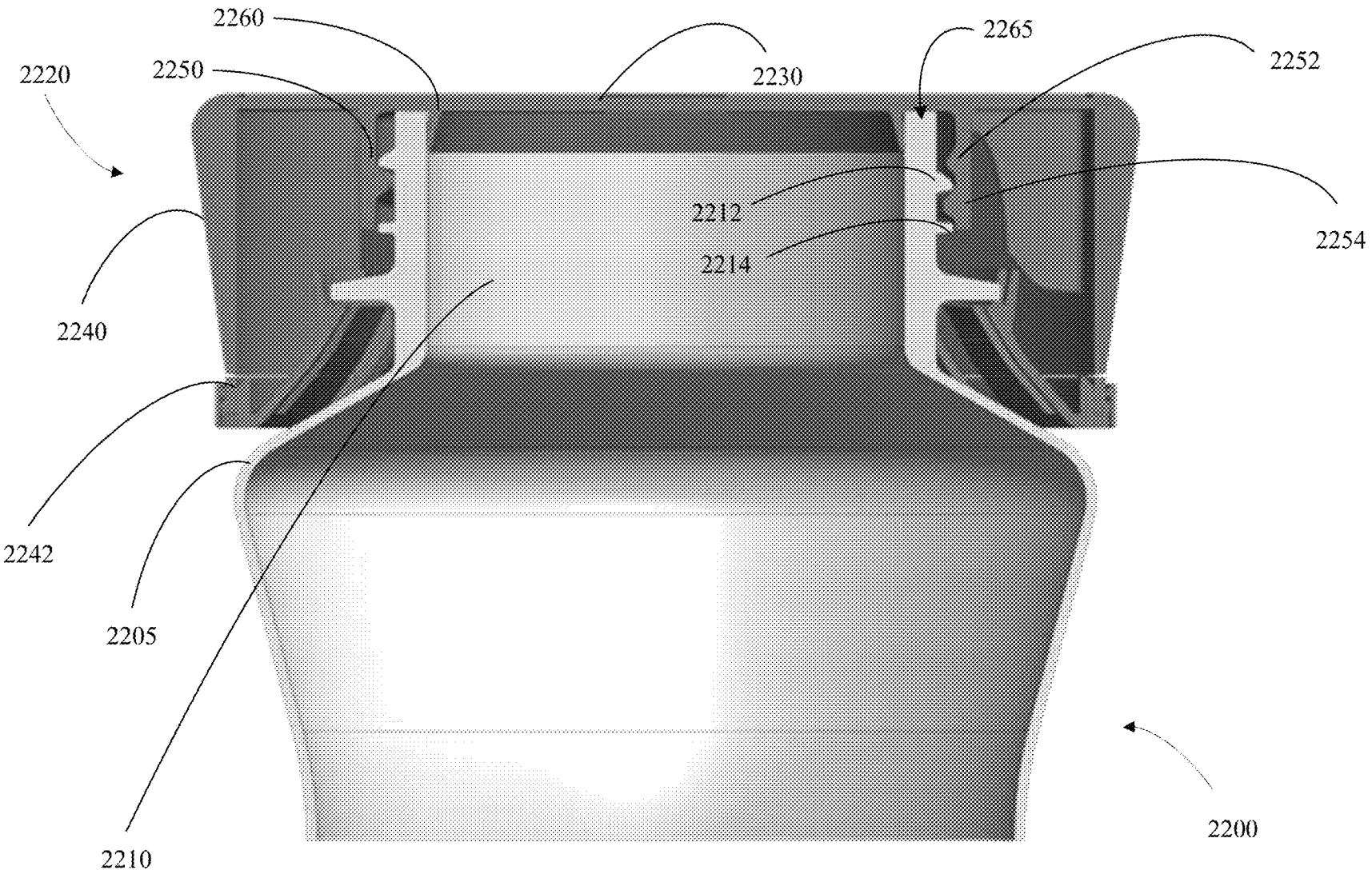
FIG. 24 is a cross-sectional view of the foilless and tamper evident cap of FIG. 22 and FIG. 23 in accordance with certain implementations.
Figure 25:
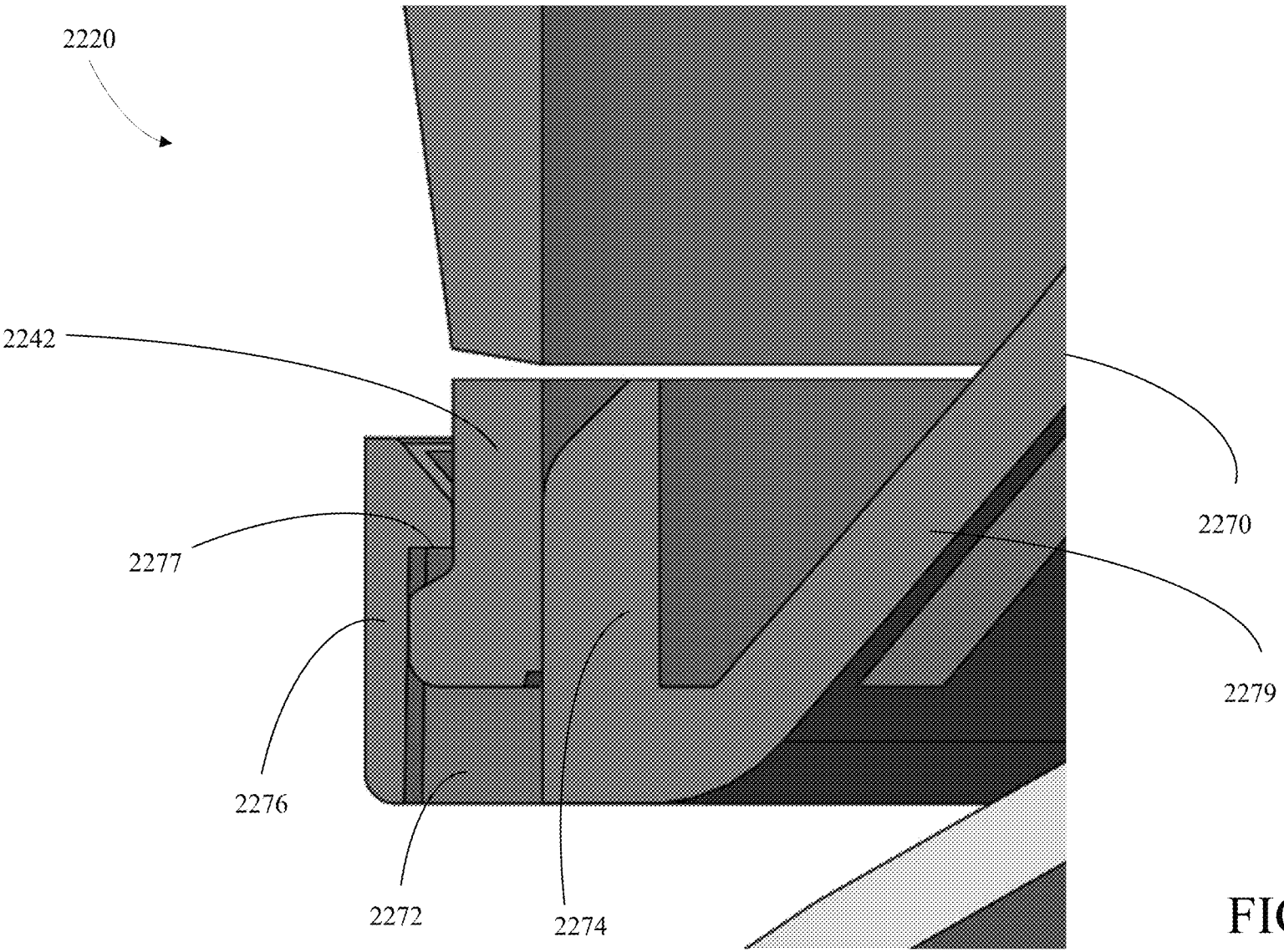
FIG. 25 is an enlarged cross-sectional view of the foilless and tamper evident cap of FIG. 22 with the tamper evident ring adapter in accordance with certain implementations.

FIG. 22 is a diagram of a container 2200 with a foilless and tamper evident cap 2220 in a closed position in accordance with certain implementations. The foilless and tamper evident cap 2220 includes a base 2230, an outer sidewall 2240, and a tamper evident portion 2242 (as shown in FIG. 24 and FIG. 25) connected to the outer sidewall 2240 via tearable elements 2244. The foilless and tamper evident cap 2220 further includes a tamper evident ring adapter 2270 (shown in FIG. 23) with is fitted to the tamper evident portion 2242. The container 2200 with the foilless and tamper evident cap 2220 functions and operates as described in FIG. 10 and the description herein is directed to different aspects of the foilless and tamper evident cap 2220.

Figure 23:
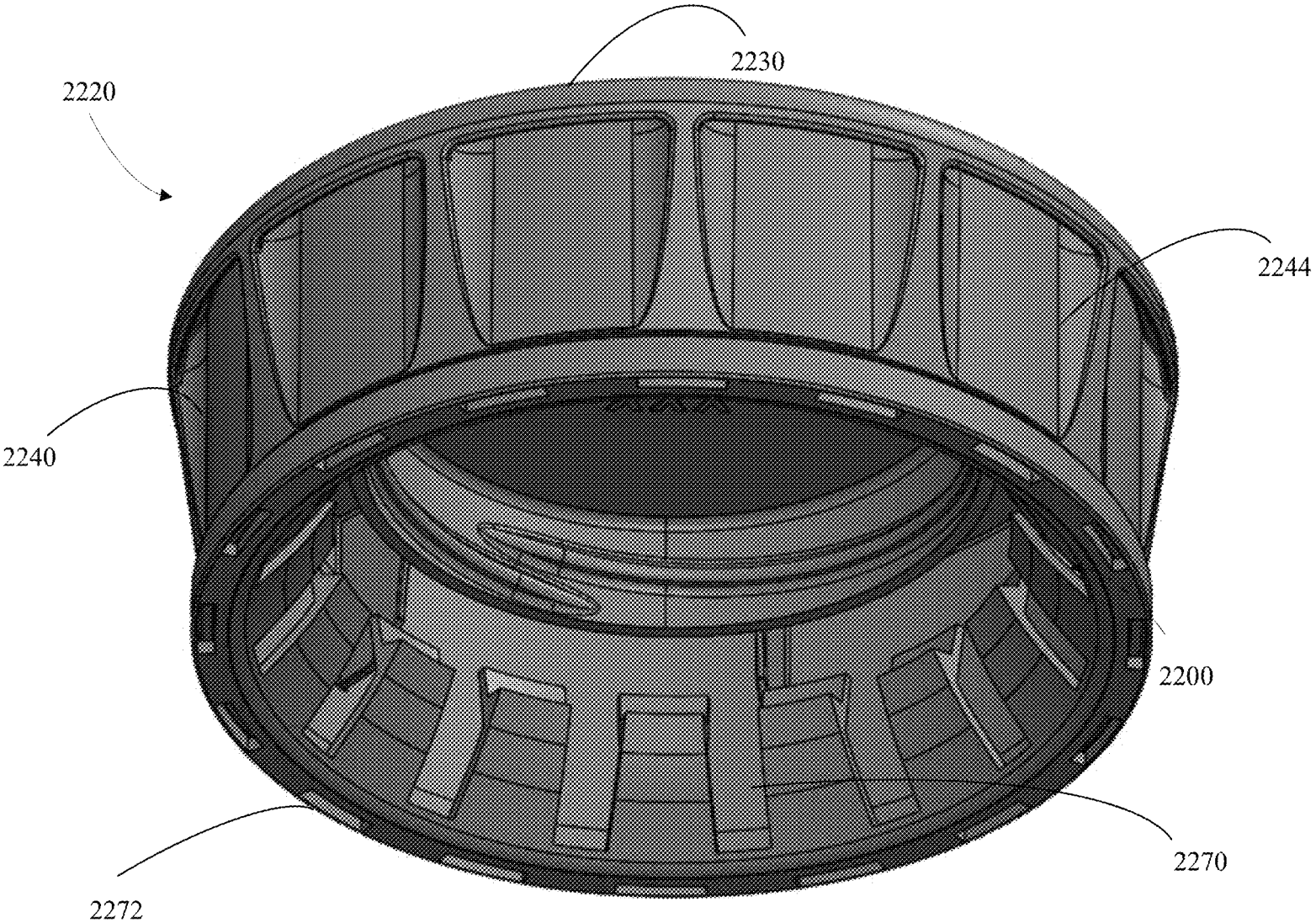
FIG. 23 is a perspective view of the foilless and tamper evident cap of FIG. 22 in accordance with certain implementations.

FIG. 23 is a perspective view of the foilless and tamper evident cap 2220 of FIG. 22 in accordance with certain implementations. The foilless and tamper evident cap 2220 includes the base 2230, the outer sidewall 2240, and the tamper evident portion 2242 connected to the outer sidewall 2242 via the tearable elements 2244 (not shown). As mentioned, the foilless and tamper evident cap 2220 includes the tamper evident ring adapter 2270 with is fitted to the tamper evident portion 2242. The tamper evident ring adapter 2270 includes a plurality of slits or openings 2272 for forming a horizontal retaining surface as described herein.

The tamper evident ring adapter 2270 is configured to fit below the collar and above the shoulder as described herein. The tamper evident portion 2242 breaks off from the tamper evident cap 2220 and the tamper evident ring adapter 2270 remains on the container 2200 after opening the foilless and tamper evident cap 2220. The opening action breaks the tamper evident portion 2242 from the outer sidewall 2240 and separates the tamper evident portion 2242 and the tamper evident ring adapter 2270 from the rest of the foilless and tamper evident cap 2220. The use of the foilless and tamper evident cap 2220 thus eliminates the foil seal, label, application operations, and slitting operations while moving the tamper evident mechanisms to the cap mold. The tamper evident ring adapter 2270 is low cost and assembles after closure molding with the lining operation.

FIG. 24 is a cross-sectional view of the foilless and tamper evident cap 2220 of FIG. 22 and FIG. 23 in accordance with certain implementations. The foilless and tamper evident cap 2220 includes the base 2230, the outer sidewall 2240, a middle sidewall 2250, and an inner sidewall 2260. The width and height of the outer sidewall 2240 and the base 2230 is dimensioned to accommodate the width of the shoulder 2205 of the container 2200 and the height of at least the neck 2210 and the shoulder 2205 of the container 2200. The middle sidewall 2250 has projections 2252 and 2254 which face toward the inner sidewall 2260. The projections 2252 and 2254 of the middle sidewall 2250 are shaped to diametrically interfere with and frictionally fit with the threads 2212 and 2214 of the container 2200 to provide a non back-off mechanism which provides an audible and tactile indicator to a consumer or user that the container 2200 is closed. The inner sidewall 2260 is angled downward toward the middle sidewall 2250 and configured to fit inside the neck 2210 of the container 2200. The middle sidewall 2250 and the inner sidewall 2260 thus form a V-shaped groove 2265 which is designed to engage the neck 2210 of the container 2200 and provide a linerless plug seal for the container 2200. The foilless and tamper evident cap 2220 thus eliminates the foil seal and lining operations.

Figure 28:
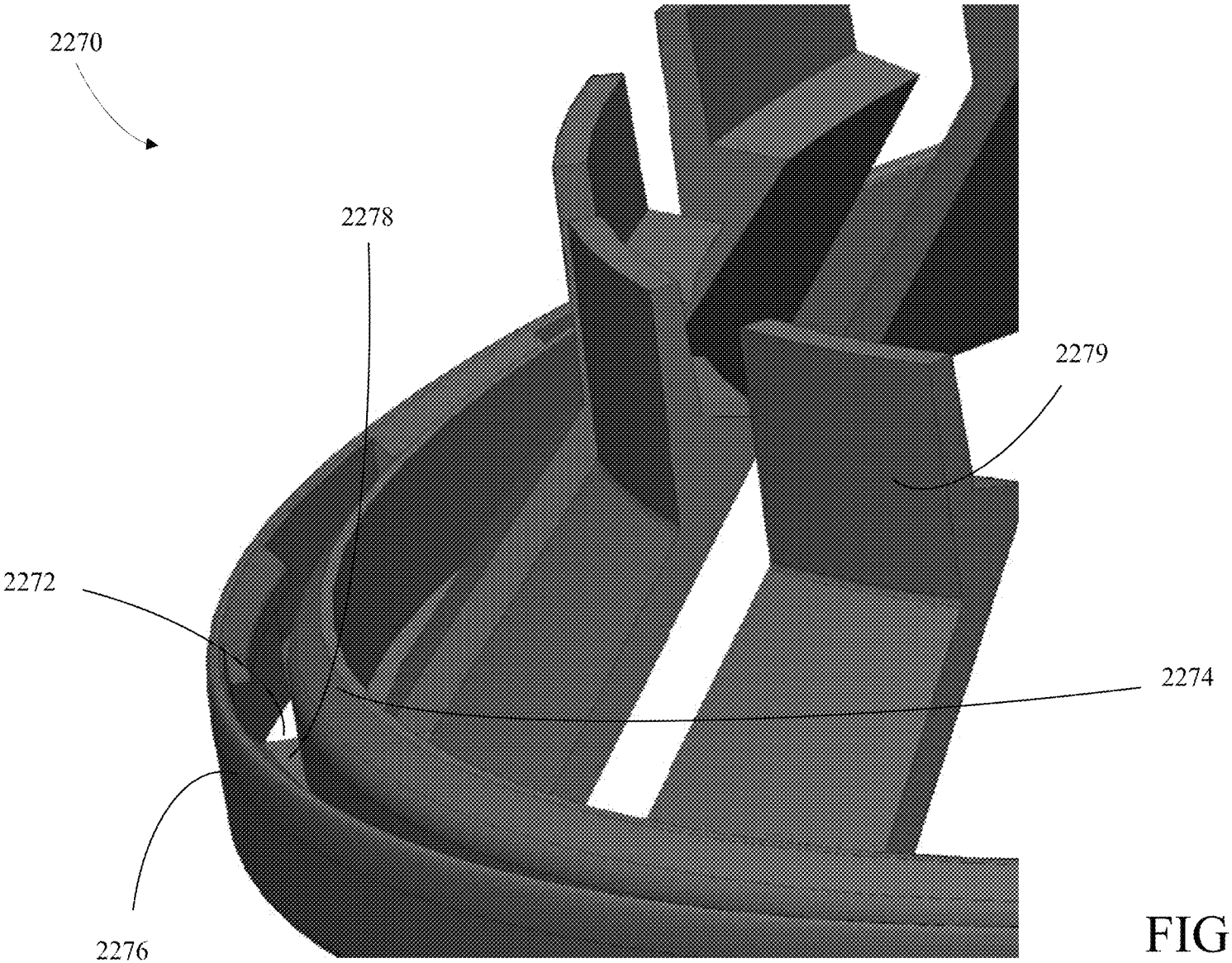
FIG. 28 is a perspective view of the tamper evident ring adapter of FIG. 23 in accordance with certain implementations.

FIG. 25 is an enlarged cross-sectional view of the foilless and tamper evident cap 2220 with the tamper evident ring adapter 2270. Certain elements which are illustrated in FIG. 22 and FIG. 23 are not labeled in FIG. 25 for purposes of clarity. The tamper evident ring adapter 2270 includes an inner wall 2274 and an outer wall 2276 which are connected in part by a base 2278 (as shown in FIG. 28), where the base 2278 is interspersed with the plurality of slits 2272. The outer wall 2276 includes a horizontal retainment surface 2277. The horizontal retainment surface 2277 is formed after molding of the tamper evident ring adapter 2270 using a notched knife slitting technique enabled via the plurality of slits 2272. In FIG. 25, the tamper evident ring adapter 2270 is shown fitted to the tamper evident portion 2242 in a non-used condition. The tamper evident ring adapter 2270 fits to the tamper evident portion 2242 and is held in place by the cooperation of the inner wall 2274, the outer wall 2276, and the horizontal retainment surface 2277. The tamper evident ring adapter 2270 can include multiple fingers 2279 which engage with the collar 2216 and the neck 2210 of the container 2200.

Figure 26:
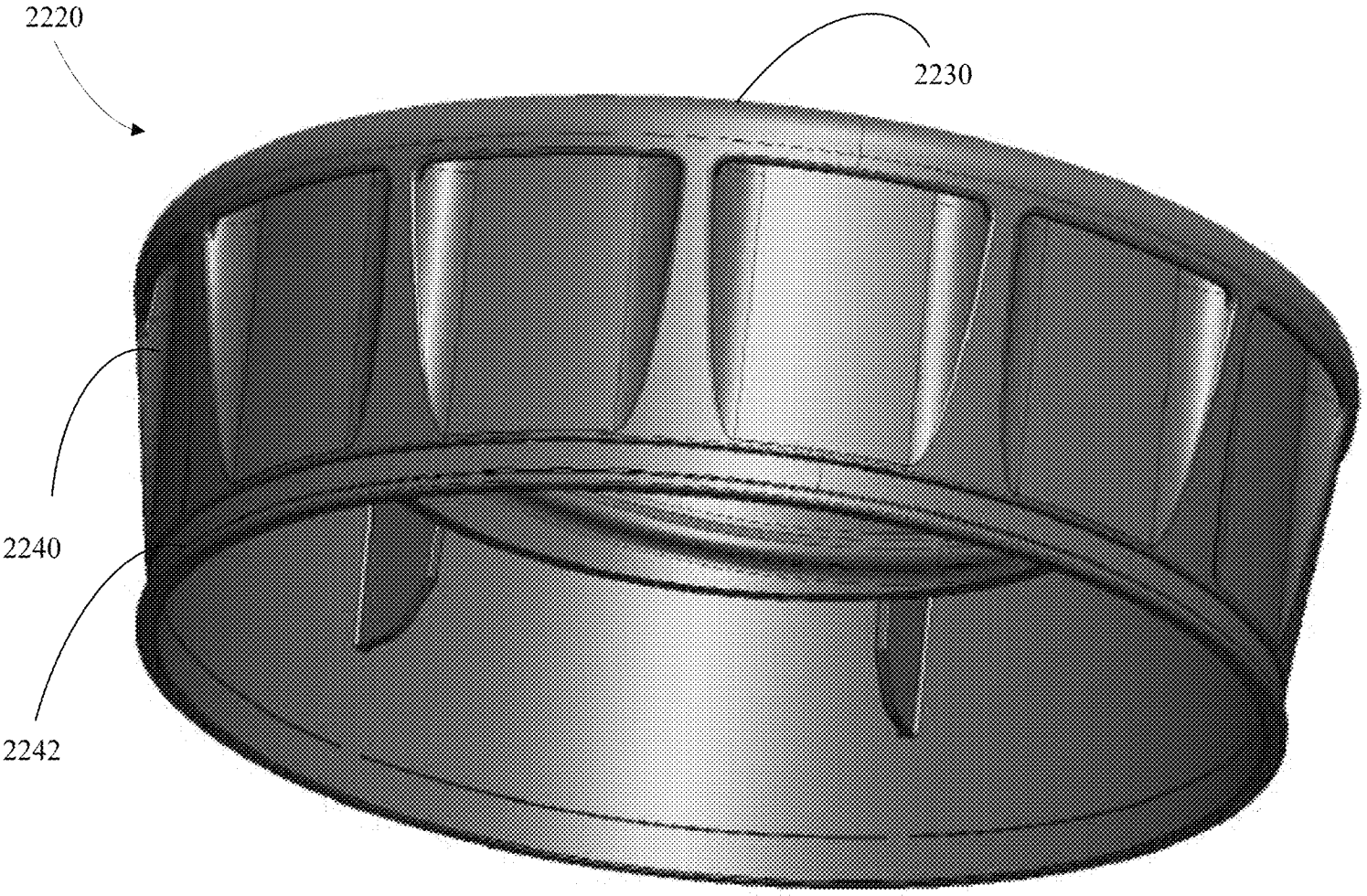
FIG. 26 is a perspective view of the foilless and tamper evident cap of FIG. 22 without the tamper evident ring adapter in accordance with certain implementations.

FIG. 26 is a perspective view of the foilless and tamper evident cap 2220 of FIG. 22 without the tamper evident ring adapter 2270. The foilless and tamper evident cap 2220 includes the base 2230, the outer sidewall 2240, and the tamper evident portion 2242 connected to the outer sidewall 2242 via the tearable elements 2244.

Figure 27:
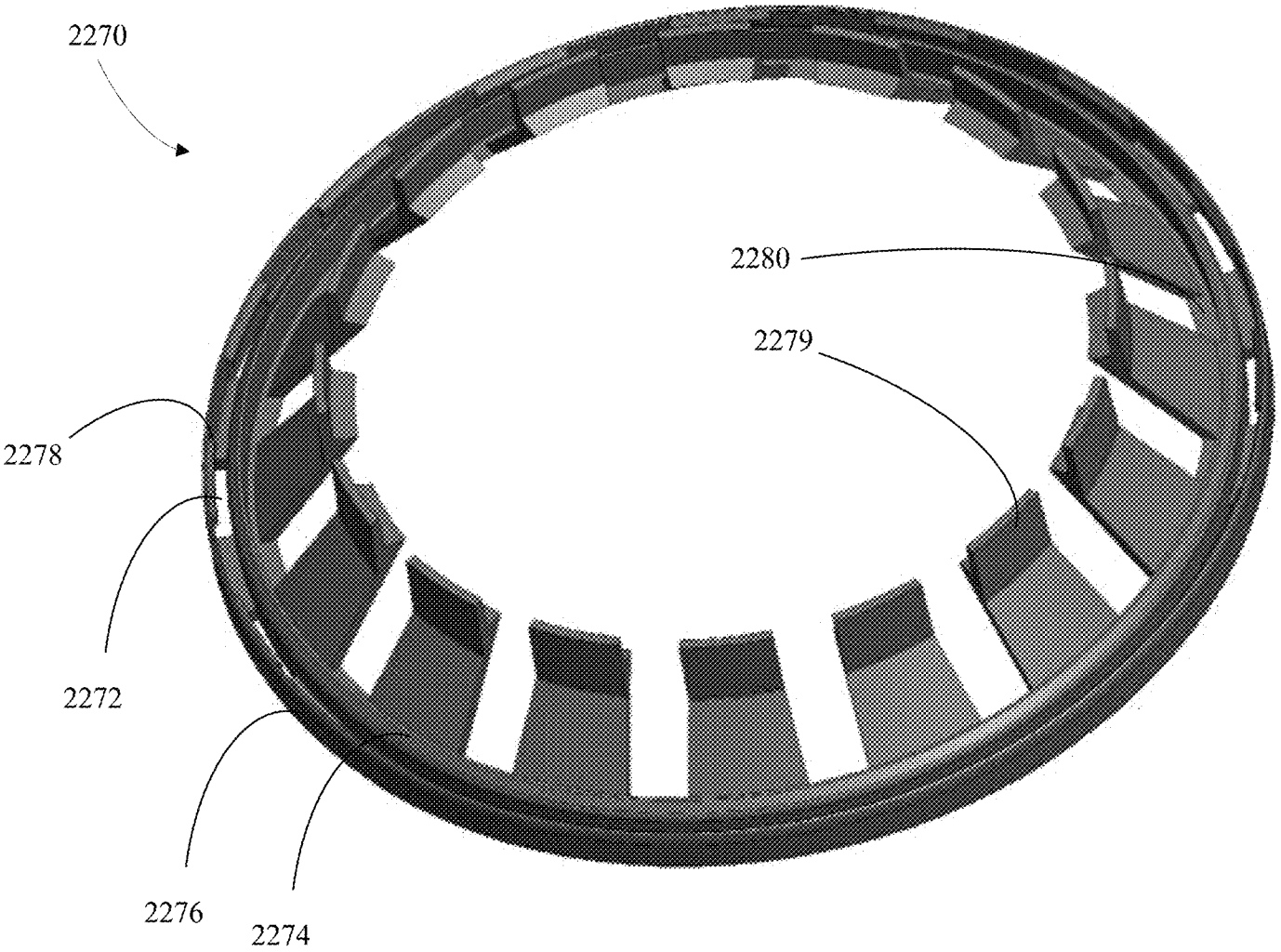
FIG. 27 is a perspective view of the tamper evident ring adapter of FIG. 23 in accordance with certain implementations.

FIG. 27 is a perspective view of the tamper evident ring adapter 2270 of FIG. 23. The tamper evident ring adapter 2270 includes the inner wall 2274 and the outer wall 2276 which are connected in part by the base 2278, where the base 2278 is interspersed with the plurality of slits 2272. The tamper evident ring adapter 2270 also includes multiple fingers 2279 which engage with the collar 2216 and the neck 2210 of the container 2200. The multiple fingers 2279 are connected to an inner base 2280, which in turn is connected to the inner wall 2274.

FIG. 28 is a perspective view of the tamper evident ring adapter 2270 of FIG. 23. The tamper evident ring adapter 2270 includes the inner wall 2274 and the outer wall 2276 which are connected in part by the base 2278, where the base 2278 is interspersed with the plurality of slits 2272. The tamper evident ring adapter 2270 also includes the horizontal retainment surface 2277. The tamper evident ring adapter 2270 also includes multiple fingers 2279 which engage with the collar 2216 and the neck 2210 of the container 2200.

Figure 29:
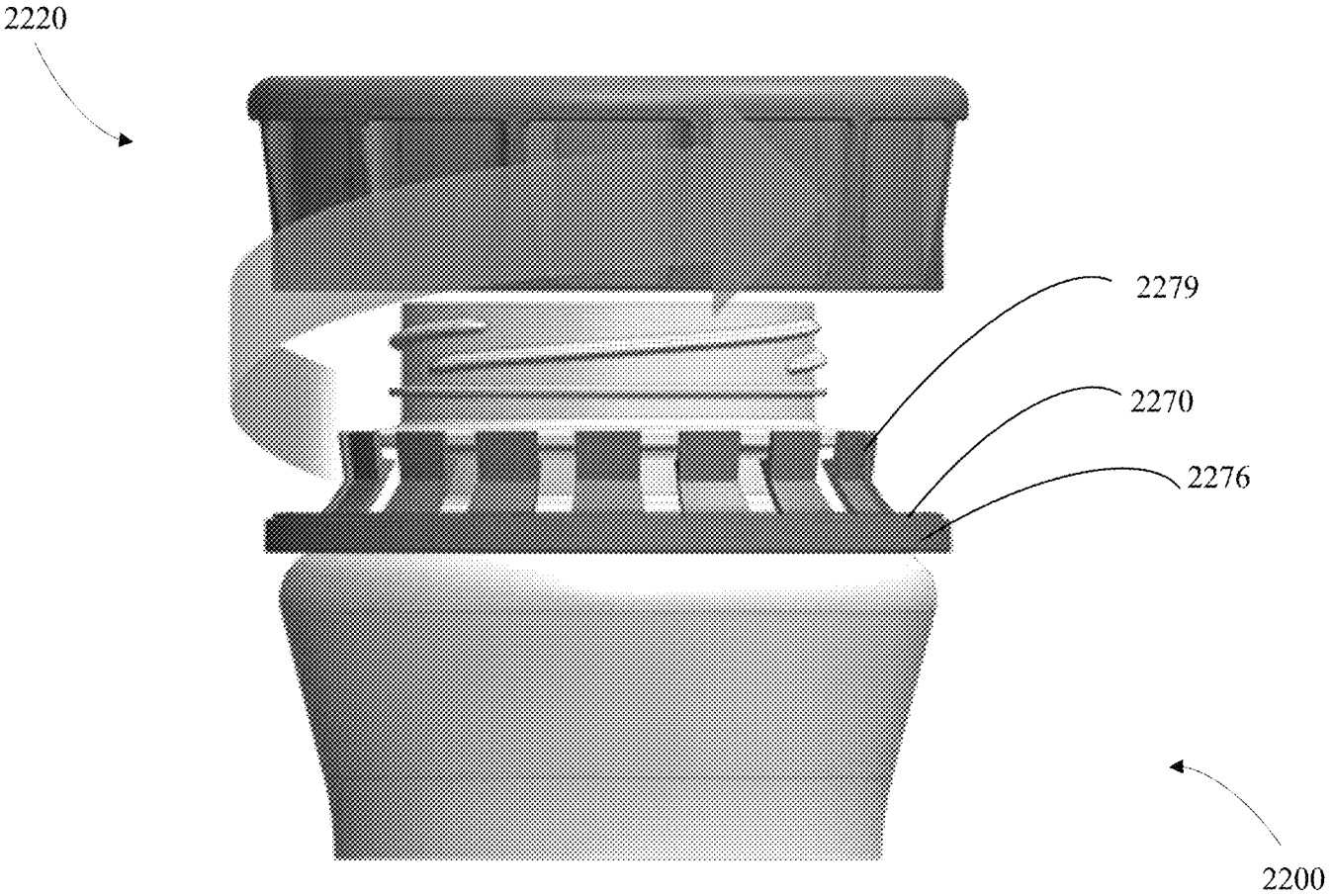
FIG. 29 is a diagram of the container and the foilless and tamper evident cap of FIG. 22, FIG. 23, FIG. 24, FIG. 25, FIG. 26, FIG. 27, and FIG. 28 in accordance with certain implementations.

FIG. 29 is a diagram of the container 2200 and the foilless and tamper evident cap 2220 of FIG. 22, FIG. 23, FIG. 24, FIG. 25, FIG. 26, FIG. 27, and FIG. 28 in accordance with certain implementations. Certain elements which are illustrated in FIG. 22, FIG. 23, FIG. 24, FIG. 25, FIG. 26, FIG. 27, and FIG. 28 are not labeled in FIG. 29 for purposes of clarity. In particular, when the foilless and tamper evident cap 2220 is twisted open from the container 2200, the multiple fingers 2279 of the tamper evident ring adapter 2270 remains on the container 2200 along with the tamper evident portion 2242 and the tamper evident ring adapter 2270. The use of the foilless and tamper evident cap 2220 thus eliminates the foil seal, lining operations, label, and application operations.

The foilless caps, foilless and tamper evident caps, and foilless, tamper evident and tethered caps described herein may be manufactured using compression molding, injection molding and other like production processes. The tethered cap and spout may be made from polypropylene, high-density polyethylene, polyethylene terephthalate (PET) and the like.

The construction and arrangement of the methods as shown in the various exemplary embodiments are illustrative only. Although only a few embodiments have been described in detail in this disclosure, many modifications are possible (e.g., variations in sizes, dimensions, structures, shapes and proportions of the various elements, values of parameters, mounting arrangements, use of materials and components, colors, orientations, etc.). For example, the position of elements may be reversed or otherwise varied and the nature or number of discrete elements or positions may be altered or varied. Accordingly, all such modifications are intended to be included within the scope of the present disclosure. The order or sequence of any process or method steps may be varied or re-sequenced according to alternative embodiments. Other substitutions, modifications, changes, and omissions may be made in the design, operating conditions and arrangement of the exemplary embodiments without departing from the scope of the present disclosure.

Although the figures may show a specific order of method steps, the order of the steps may differ from what is depicted. Also two or more steps may be performed concurrently or with partial concurrence. Such variation will depend on the software and hardware systems chosen and on designer choice. All such variations are within the scope of the disclosure. Likewise, software implementations could be accomplished with standard programming techniques with rule-based logic and other logic to accomplish the various connection steps, processing steps, comparison steps, and decision steps.

While the disclosure has been described in connection with certain embodiments, it is to be understood that the disclosure is not to be limited to the disclosed embodiments but, on the contrary, is intended to cover various modifications and equivalent arrangements included within the scope of the appended claims, which scope is to be accorded the broadest interpretation so as to encompass all such modifications and equivalent structures as is permitted under the law.

What is claimed is:

1. A cap for a container, the cap comprising:

a base;

an outer sidewall connected to the base;

a middle sidewall connected to the base;

an inner sidewall connected to the base, wherein the inner sidewall is angled toward the middle sidewall, wherein the middle sidewall includes at least one projection facing the inner sidewall which is configured to diametrically interfere with and frictionally fit with at least one thread on a neck of a container, and wherein the middle sidewall and the inner sidewall form a V-shaped groove which engages the neck to close the container absent a foil seal; and a tamper evident mechanism having a wall portion that is molded to an inner surface of the outer sidewall and that is located at least partially internal to the cap, wherein the tamper evident mechanism is configured to be positioned between a collar on the neck and a shoulder of the container that is connected to the neck and positioned below the at least one thread such that fingers of the tamper evident mechanism engage the collar, the fingers extending above the wall portion and being connected to the wall portion by tearable elements located therebetween.

2. The cap of claim 1, wherein at least a portion of the tamper evident mechanism remains on the container when the cap is opened from the container.

3. The cap of claim 2, wherein the tamper evident mechanism is integrally molded as part of the cap.

4. The cap of claim 1, wherein the at least one projection diametrically interferes with and frictionally fits with the at least one thread to provide an audible and tactile indicator to a user that the container is closed.

5. The cap of claim 1, wherein the cap provides a tactile indicator to a user that the container is closed based upon interference and friction between the at least one projection and the at least one thread.

6. The cap of claim 1, wherein the inner sidewall is configured to fit inside the neck of the container.

7. The cap of claim 1, wherein the V-shaped groove is configured to provide a linerless plug seal for the container.

8. A device comprising:

a container including a shoulder and a neck; and a foilless cap configured to fit on the container, wherein the foilless cap comprises:

a base, a width of the base dimensioned to accommodate a width of the shoulder;

an outer sidewall connected to the base, a height of the outer sidewall dimensioned to accommodate a height of the neck;

a middle sidewall connected to the base;

an inner sidewall connected to the base, wherein the inner sidewall is angled toward the middle sidewall, wherein the middle sidewall includes at least one projection facing the inner sidewall which is configured to diametrically interfere with and frictionally fit with at least one thread on the neck of the container, and wherein the middle sidewall and the inner sidewall form a V-shaped groove which engages the neck to close the container absent a foil seal; and a tamper evident mechanism having a wall that is formed with an inner surface of the outer sidewall and that is located at least partially internal to the foilless cap, wherein the tamper evident mechanism is configured to be positioned between a collar on the neck and the shoulder of the container that is connected to the neck and positioned below the at least one thread, and wherein the collar extends outward from the neck toward the outer sidewall and above the wall of the tamper evident mechanism, the collar being located between, and spaced apart from, the at least one thread on the neck and the shoulder of the container.

9. The device of claim 8, wherein at least a portion of the tamper evident mechanism remains on the container when the foilless cap is opened from the container.

10. The device of claim 8, wherein the foilless cap provides a tactile indicator to a user that the container is closed based upon interference and friction between the at least one projection and the at least one thread.

11. The device of claim 8, wherein the tamper evident mechanism is an adapter ring that includes:

fingers configured to engage the collar on the neck of the container, wherein the fingers are connected to the wall by tearable elements that are configured to break during opening of the foilless cap to separate the fingers from the wall.

12. The device of claim 11, wherein the fingers are configured to remain connected to the container when the foilless cap is opened.

13. The device of claim 12, wherein the fingers extend upward beyond a top edge of the wall.

14. The device of claim 11, wherein the fingers extend inward from the wall and are configured to extend inwards towards the neck of the container.

15. The device of claim 11, wherein the fingers are spaced apart from the wall and located radially inward of the wall.

* * * * *